US006511168B2

(12) United States Patent
Higuma

(10) Patent No.: US 6,511,168 B2
(45) Date of Patent: Jan. 28, 2003

(54) INK CONTAINER AND INK JET CARTRIDGE

(75) Inventor: Masahiko Higuma, Tohgane (JP)

(73) Assignee: Canon Aptex Kabushiki Kaisha, Ibaraki (JP)

( * ) Notice: Subject to any disclaimer, the term of this patent is extended or adjusted under 35 U.S.C. 154(b) by 0 days.

(21) Appl. No.: 09/835,393

(22) Filed: Apr. 17, 2001

(65) Prior Publication Data

US 2001/0048456 A1 Dec. 6, 2001

(30) Foreign Application Priority Data

Apr. 18, 2000 (JP) ..... 2000-117066
Apr. 2, 2001 (JP) ..... 2001-103825

(51) Int. Cl.[7] ..... B41J 2/175
(52) U.S. Cl. ..... 347/86
(58) Field of Search ..... 347/85, 86, 87, 347/92

(56) References Cited

U.S. PATENT DOCUMENTS

| | | | | | |
|---|---|---|---|---|---|
| 2,935,075 | A | | 5/1960 | Ringer | 137/43 |
| 5,040,002 | A | | 8/1991 | Pollacek et al. | 347/87 |
| 5,500,663 | A | * | 3/1996 | Ujita et al. | 347/86 |
| 5,509,140 | A | | 4/1996 | Koitabashi et al. | 347/86 |
| 5,619,239 | A | * | 4/1997 | Kotaki et al. | 347/86 |
| 5,742,311 | A | | 4/1998 | Koitabashi et al. | 347/86 |
| 5,801,737 | A | | 9/1998 | Sato et al. | 347/86 |
| 5,949,456 | A | | 9/1999 | Matsumoto et al. | 347/85 |
| 5,953,030 | A | | 9/1999 | Ishinaga et al. | 347/86 |
| 6,036,305 | A | * | 3/2000 | Nagasaki et al. | 347/86 |
| 6,050,681 | A | | 4/2000 | Yamashita et al. | 347/86 |
| 6,382,783 | B1 | * | 5/2002 | Hayashi et al. | 347/85 |
| 2002/0071011 | A1 | * | 6/2002 | Hayashi et al. | 347/86 |

FOREIGN PATENT DOCUMENTS

| | | |
|---|---|---|
| EP | 437363 | 7/1991 |
| EP | 709207 | 5/1996 |
| EP | 738605 | 10/1996 |
| EP | 925935 | 6/1999 |
| JP | 10-217495 | 8/1998 |
| WO | 92/21589 | 12/1992 |

OTHER PUBLICATIONS

EPO Search Report, European Patent Office, Aug. 2002, pp.1–5.*

* cited by examiner

*Primary Examiner*—Michael Nghiem
(74) *Attorney, Agent, or Firm*—Fitzpatrick, Cella, Harper & Scinto

(57) ABSTRACT

An ink container for supplying ink out of a main body thereof through an ink supply port. The container includes an ink retaining material for retaining the ink in the main body of the container, a pressure adjusting device for adjusting a pressure in the main body, and a valve member disposed in the ink supply port. The valve includes a substantially non-elastic plug member for plugging the ink supply port and an elastic member for urging the substantially non-elastic member toward the ink supply port.

20 Claims, 16 Drawing Sheets

INK CONTAINER AND INK JET CARTRIDGE

FIELD OF THE INVENTION AND RELATED ART

The present invention relates to an ink container for storing ink, and an ink jet cartridge comprising such an ink container.

In some cases, an ink container for supplying ink to the recording head of an ink jet recording apparatus is placed apart from the recording head so that the level of the ink within the ink container is differentiated from the level of the recording head in order to use head pressure difference to provide the recording head with a stable supply of ink. In these cases, there is a possibility that if the balance in head pressure is disturbed, ink might leak from the recording head, and/or the recording head might be supplied with an insufficient amount of ink, which might result in the deterioration of recording performance.

In other cases, an ink container is mounted on a carriage along with a recording head, and an ink retaining member, which retains ink by generating a predetermined amount of ink retaining force, is placed within the ink container. More specifically, a porous ink absorbing member, as an ink retaining member, is placed within the ink container to cause the ink absorbing member to absorb and retain ink so that negative pressure is generated in the ink container by the capillarity in the ink absorbing member. Thus, unless the properties of the ink absorbing member as a negative pressure generation source are optimized for negative pressure generation, ink might leak from the recording head and/or recording performance might deteriorate due to the insufficient supply of ink to the recording head.

In the cases of the above described ink delivery structures, the internal pressure of an ink container tends to be affected by the changes in the environmental factors, for example, ambient temperature, atmospheric pressure, vibration, and the like. It also tends to be affected by the manner in which the recording head is driven, because the manner in which recording head is driven affects the amount of ink supplied to the recording head. Further, there is a possibility that as the internal pressure of an ink container changes, the ink retaining member such as the aforementioned ink absorbing member might fail to properly retain the ink within the ink container.

One of the proposals for improving the above described structures is disclosed in U.S. Pat. No. 5,500,663, according to which ink supplying performance is improved by providing an ink container with a single or plurality of substructures for regulating the internal pressure of the main structure of the ink container.

SUMMARY OF THE INVENTION

The addition of a pressure regulating means made it possible to stably supply ink, and also to suppress the fluctuation of the internal pressure of an ink container for which changes in the environment of the ink container are responsible.

However, the addition of a pressure regulating means alone was not sufficient to completely solve the problems, since an ink container such as the above described one was structured so as to be removably connected to an ink jet recording head such as the above described one. In other words, there was much to be improved regarding the juncture between the ink container and recording head in terms of stability and reliability.

Regarding the structure of the junction, there have been many proposals, according to which the ink delivering portion of an ink container is provided with a valving structure. However, those proposals leave much to be improved. That is, the provision of a valving structure increases component count, which results in such problems as structural complication and cost increase. In other words, those proposals are problematic in that they fail to provide an inexpensive ink container.

Accordingly, the principal object of the present invention is to provide an ink container capable of always properly retaining ink within the main structure of the ink container in order to stably supply ink even if changes occur to the environment of the ink container, by providing the ink delivering portion (connecting portion) of the ink container with a valving structure which is simple and reliable, and also to provide an ink jet cartridge comprising such an ink container.

According to an aspect of the present invention, there is provided an ink container for supplying ink out of a main body thereof through an ink supply port, said container comprising an ink retaining material for retaining the ink in the main body of the container; pressure adjusting means for adjusting a pressure in the main body; and a valve member disposed in the ink supply port; said valve including a substantially non-elastic plug member for plugging said ink supply port and an elastic member for urging said substantially non-elastic member toward said ink supply port.

According to another aspect of the present invention, there is provided an ink cartridge comprising an ink container as defined above; an ink jet recording head capable of ejecting the ink supplied through said ink supply port of said ink container.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

(Embodiment 1)

Figure 1:
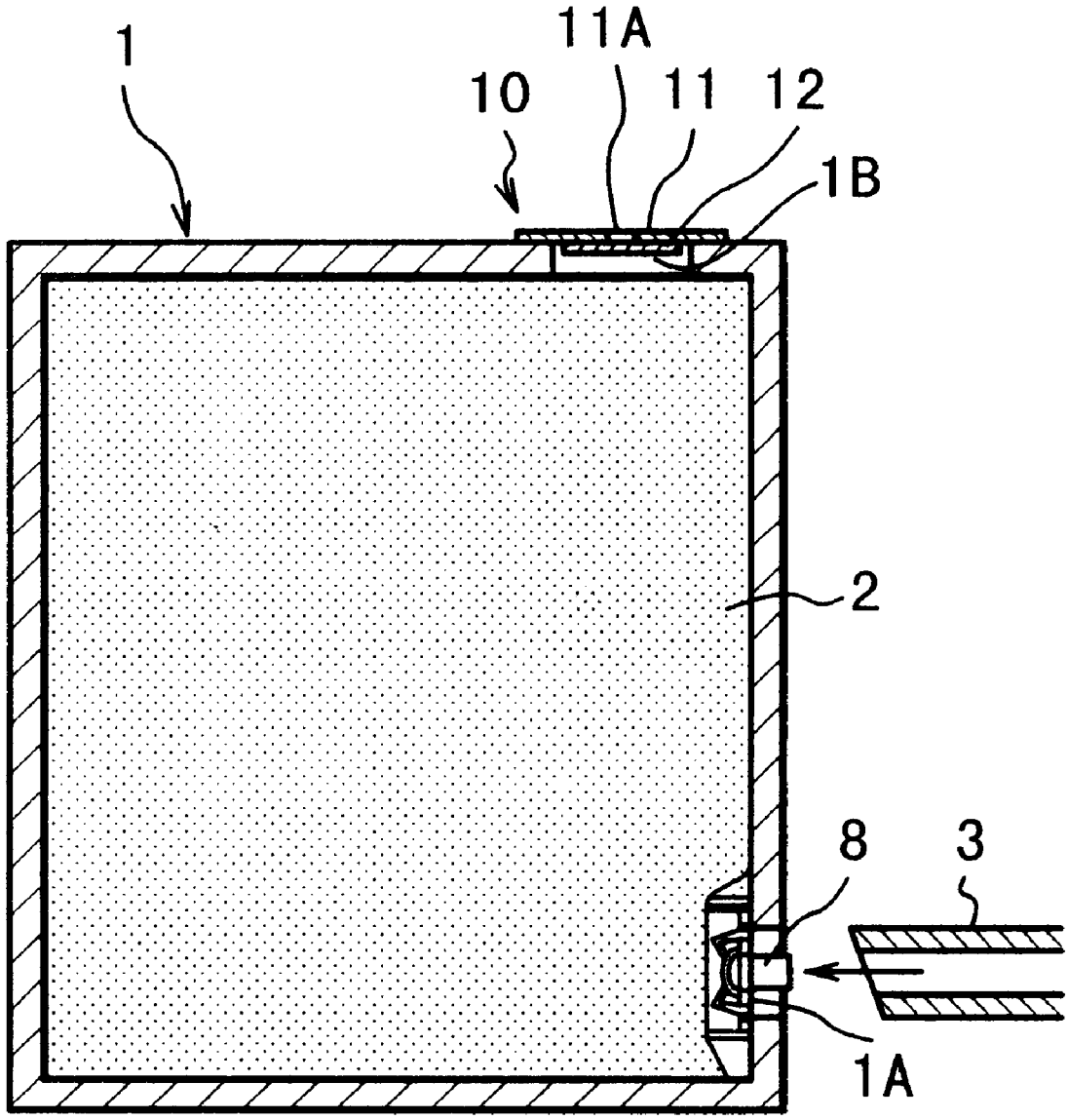
FIG. 1 is a sectional view of the ink container in the first embodiment of the present invention.

Referring to FIG. 1, a referential code 1 designates the main structure of an ink container, which contains a porous ink absorbing member 2 as an ink retaining member which retains ink by generating a certain amount of ink retaining force. The ink container main structure 1 is provided with an ink delivery hole 1A through which an ink delivery tube 3 is put from the direction indicated by an arrow mark in FIG. 1, and a hole 1B as an air vent. The hole 1B is fitted with a valving mechanism 10 as a pressure regulating means, and the ink delivery hole 1A is fitted with a valving mechanism 8 which prevents ink from leaking from the ink delivery hole 1A when the ink container main structure 1 is not in connection with a recording head. The valving mechanism 10 has a first thin film designated by a referential code 11, and the first thin film 11 has a hole 11A, which is located in the center of the thin film 11. Designated by a referential code 12 is a second thin film, which is smaller in diameter than the hole 1B, but is larger in diameter than the hole 11A.

Figure 2:
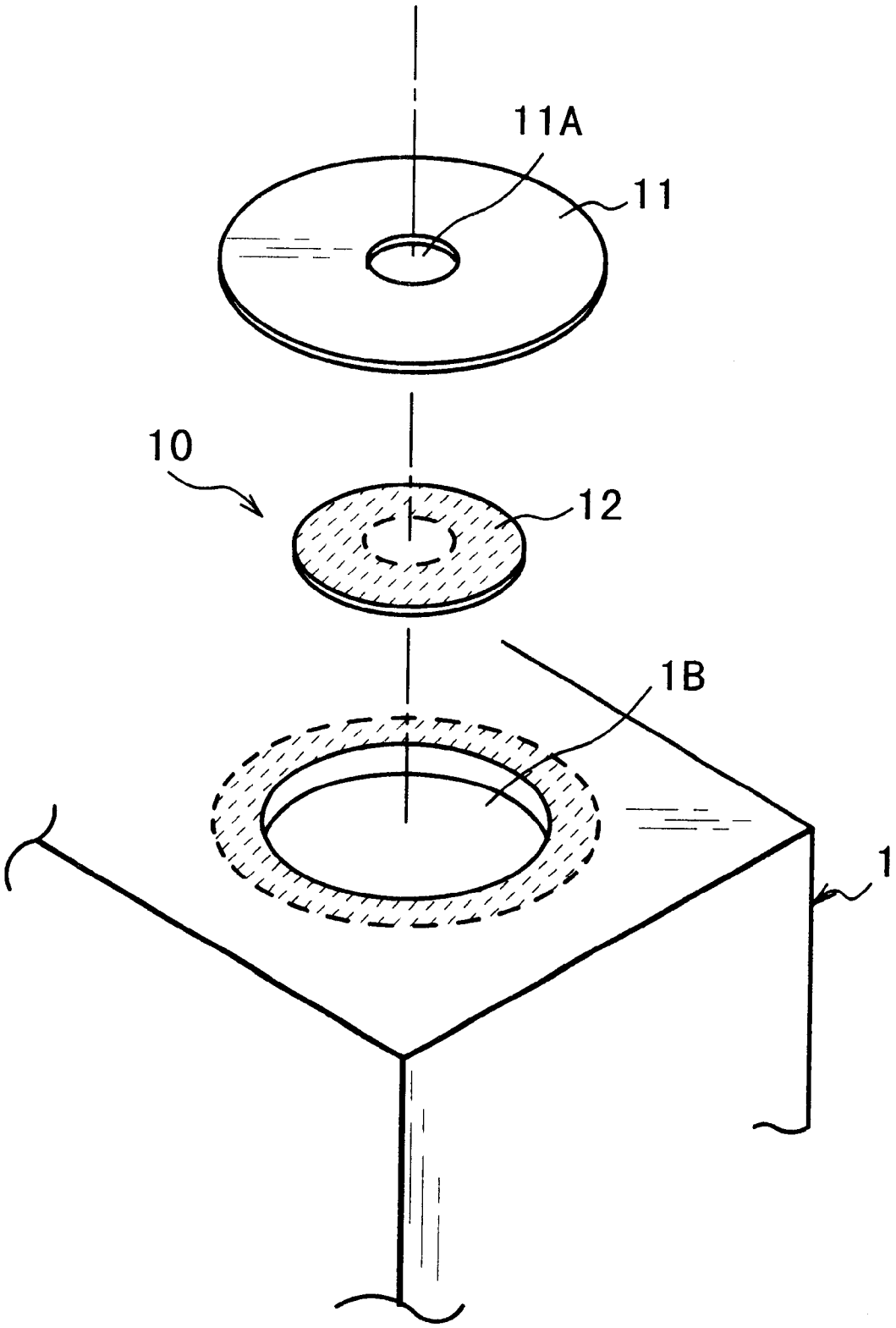
FIG. 2 is an exploded perspective view of the valving mechanism in FIG. 1.
Figure 3:
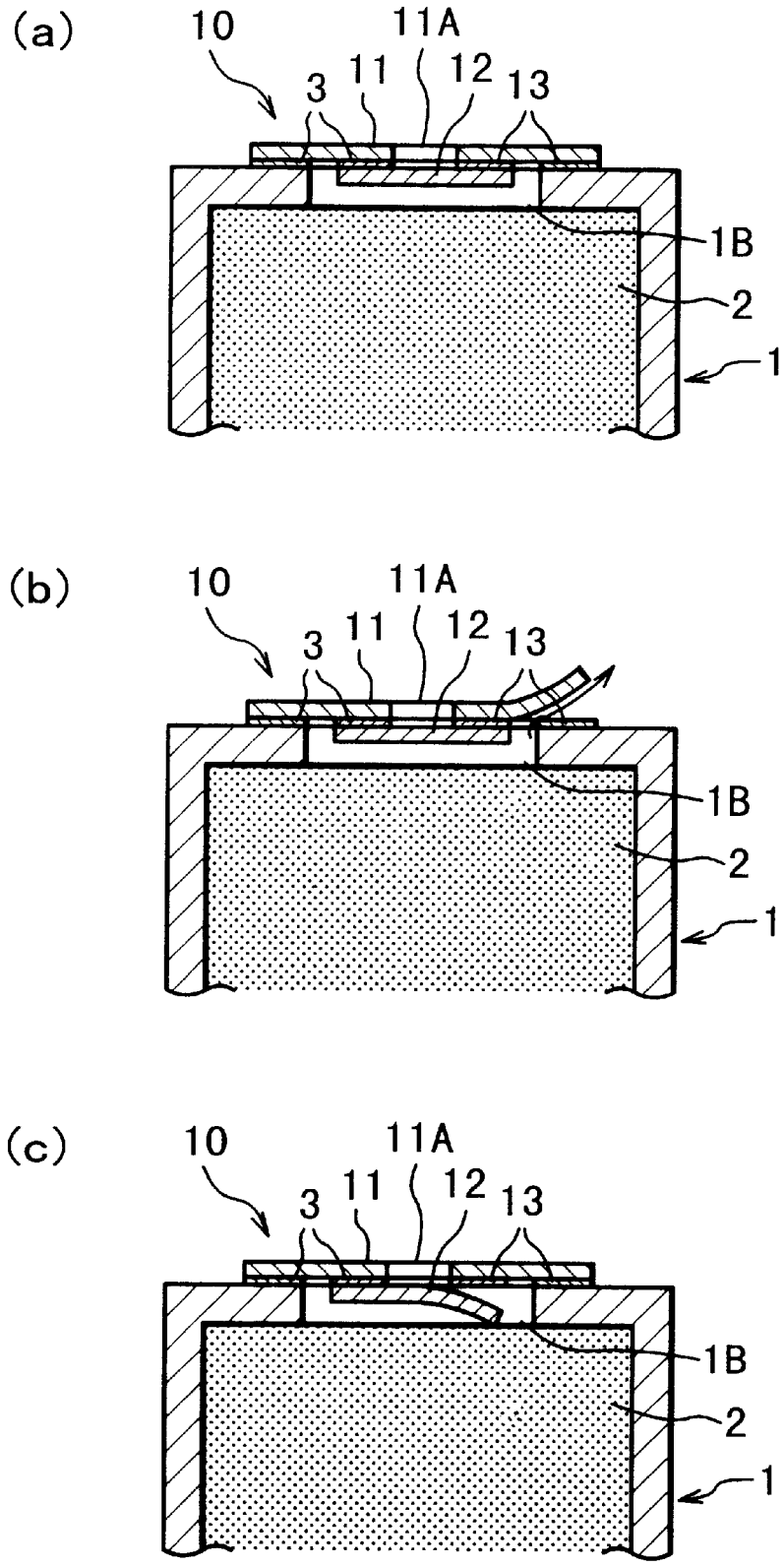
FIGS. 3(*a*), 3(*b*), and 3(*c*) are sectional views of the valving mechanism in FIG. 1, for describing the operation of the valving mechanism.

Referring to FIG. 2, the areas hatched with dotted lines are coated with viscous sealer 13 such as silicon oil. Referring to FIG. 3(*a*), the sealer 13 coated on these areas nonpermanently seals between the outwardly facing surface of the ink container main structure 1 and the inwardly facing surface of the first thin film 11, in the fringe area of the hole 1B of the ink container main structure, and also, between the inwardly facing surface of the first thin film and outwardly facing surface of the second thin film 12, in the fringe area of the hole 11A of the first thin film 11.

As for the sealer 13, nonvolatile liquid substances having viscosity within a range of 1000–5000 cst, for example, silicon oil, can be used. The sealer 13 is desired to be as small as possible in the changes in physical properties, such as viscosity, resulting from temperature fluctuation.

The ink absorbing member 2 in the ink container main structure configured as described above generates negative pressure as it absorbs and retains ink because of the capillarity in the ink absorbing member 2. Therefore, when ink is supplied to an ink jet recording head through an ink delivery tube 3, the recording head must generate ink drawing force greater than a certain amount of force, inclusive of the capillary force from the ink absorbing member 2. Otherwise, the recording head cannot draw ink. Thus, ink is prevented from leaking from the recording head.

As the amount of the ink within the ink container main structure 1 reduces, the internal pressure of the ink container main structure 1 falls. As the internal pressure of the ink container main structure 1 falls below a predetermined level, the second thin film 12 temporarily deforms, creating a gap between the first and second thin films 11 and 12, through the sealer 13, as shown in FIG. 3(*c*). As a result, the ambient air is introduced into the ink container main structure 1. Therefore, the internal pressure of the ink container main structure 1 does not fall below the predetermined level, allowing the ink within the ink container main structure 1 to be smoothly delivered. Further, if the internal pressure of the ink container main structure 1 falls below the predetermined level due to the ambient condition of the ink container, or the like, the valving mechanism 10 functions in the same manner. On the other hand, if the internal pressure of the ink container main structure 1 rises above a predetermined level due to the ambient condition of the ink container main structure 1, or the like, the first thin film 11 temporarily deforms, creating a gap between the first thin film 11 and ink container main structure 1, through the sealer 13, as shown in FIG. 3(*b*). As a result, the internal pressure of the ink container main structure 1 is released to the atmosphere. Therefore, the internal pressure of the ink container main structure 1 does not increase beyond the predetermined level, preventing the excessive increase in the internal pressure of the ink container main structure 1. After the opening, the valving mechanism 10 quickly shuts because of the elasticity of the thin films 11 and 12, and the surface tension of the sealer 13. The pressure level (valve opening threshold pressure) at which the valving mechanism 10 opens can be set to be optimum according to the elasticity of the thin films 11 and 12, the viscosity and surface tension of the sealer 13, the size of the contact area between the thin films 11 and 12, the size of the contact area between the thin film 11 and ink container main structure 1, and the like factors.

Referring to FIGS. 4(A)–4(C), the essential components of the valving mechanism 8 fitted in the ink delivery hole 1A are a valve 8*a* and a plurality of elastic pressing members 8*d*.

The valve 8*a* has a valve head 8*b* which blocks ink delivery hole 1A, and a valve stem 8*c* which extends outward. The elastic pressing members 8*d* keep the valve 8*a* pressed toward the ink delivery hole 1A. The valve 8*a* is provided with a plurality of grooves 8*e* which function as ink delivery paths after the valve 8*a* is moved to its open position by the insertion of the ink delivery tube 3. The valve 8*a* is enabled to move inward of the ink container main structure 1 as it is pushed by the ink delivery tube 3. In order to assure the movement of the valve 8*a*, and also for the sake of recyclability of the valve 8*a*, the valve 8*a* is desired to be formed of the same material as that of the ink container, which is relatively hard.

Referring to FIG. 4(A), the ink delivery hole 1A is fitted with a valve seat 9, and the valve 8*a* is fitted in the center hole of the valve seat 9. In this embodiment, four elastic pressing members 8*d* are provided for pressing the valve 8*a*. They are placed in contact with the top portion of the valve head 8*b* in a manner to keep the valve 8*a* toward the ink delivery hole 1A (valve seat 9), so that the ink delivery hole 1A is kept blocked.

FIG. 4(B) is a sectional view of the valving mechanism 8, at a plane A—A in FIG. 4(A). In the state shown in FIG. 4(B), the ink delivery hole 1A is sealed with the valve 8*a* which is under the pressure from the elastic pressing members 8*d*. More specifically, the valve head 8*b* of the valve 8*a* is kept in contact with the valve seat 9 by the elastic pressing members 8*d*. In this state, if the contact between the valve head 8*b* and valve seat 9 is imperfect, ink may leak. Therefore, it is desirable to form a circular rib (unshown) around the center hole of the valve seat 9 to assure that the valve head 8*b* and valve seat 9 make leak-free contact with each other. In order to improve the reliability of the leak-free contact between the rib of the valve seat 9, and the valve head 8*b* formed of a relatively hard material as described above, it is desired that the portion of the valve head 8*b*, which faces the rib, is formed of elastic material such as EVA, urethane rubber, silicone rubber, and the like. In such a case, the elastic material is attached to the hard material portion of the valve head 8*b*, and therefore, it does not accidentally deform, assuring that the interface between the valve head 8*b* and valve seat 9 remains reliably sealed.

A component, a portion of which is to be formed of hard material, and the rest of which is to be formed of elastic material, can be easily manufactured with the use of one of the widely known technologies, for example, two color molding.

FIG. 4(C) shows the state of the valving mechanism of the ink container 1 after the valve 8*a* has been moved inward of the ink container by the ink delivery tube 3 which has been pushed into the ink delivery hole 1A by the fitting of the ink container 1 to the recording head, against the pressure generated by the elastic pressing members 8*d*, and the state of the valving mechanism before the inward movement of the valve 8*a*. As the ink delivery tube 3 is inserted, it comes into contact with the stem 8*c* of the valve 8*a*, and pushes the valve stem 8*c* inward of the ink container 1. As a result, the valve head 8*b* is moved away from the valve seat 9, creating a gap 8*f*. Thus, the ink within the ink container flows outward through the aforementioned grooves 8*e* and this gap 8*f*, into the ink delivery tube 3 which delivers the ink to the recording head.

The internal pressure of the ink container main structure 1, the ink delivery hole 1A of which is blocked by the valve 8*a*, is kept within a predetermined range by the opening or closing of the valving mechanism 10 as described before. Therefore, the ink absorbing member 2 generates a relatively stable amount of negative pressure within the pressure range in which the internal pressure of the ink container main structure 1 is kept. Consequently, ink is more stably supplied to the recording head. The above described manner in which ink is stably supplied to the recording head assures that ink is prevented from leaking from the recording head, and also stabilizes recording performance, making it possible to record an image with higher quality.

As for the factors which affect the internal pressure of the ink container main structure 1, there are environmental factors, for example, temperature, atmospheric pressure, vibrations, and the like, and an operational factor, that is, the amount by which ink is supplied to the recording head, which is changed by the manner in which the recording head is driven. The valving mechanism 10 opens or closes to minimize the effects of these factors so that the internal pressure of the ink container main structure 1 is kept within the predetermined range to provide the recording head with a stable supply of ink. Further, it is possible that, if the ink delivery hole 1A remains sealed with a removable seal or the like, as it is during the shipment of a brand-new ink container, the internal pressure of the ink container main structure 1 will fluctuate due to the changes in the environmental factors such as temperature, atmospheric pressure, vibrations, and the like. Even under such a circumstance, or during the shipment, the valving mechanism 10 properly functions to keep the internal pressure of the ink container main structure 1 within the predetermined range. In other words, because the internal pressure of the ink container main structure 1 is always kept within the predetermined range by the valving mechanism 10, it does not occur that the ink gushes out of the ink delivery hole 1A due to the high internal pressure of the ink container main structure 1, the moment the seal is removed from the ink delivery hole 1A in order to use the ink container for the first time. Therefore, it is easier to handle the ink container. Further, the valving mechanism also plays its role when a partly used ink container is stored; it keeps the internal pressure of the partially used ink container in the predetermined pressure range. In other words, the valving mechanism 10 cooperatively works with the valving mechanism 8 fitted in the ink delivery hole 1A to prevent the ink from leaking out of the ink delivery hole 1A while the ink container is kept in storage.

The ink absorbing member 2 and valving mechanism 10 work, as two separate pressure regulating mechanisms different in properties, upon the ink within the ink container main structure 1. More specifically, the ink absorbing member 2, being provided with capillary force, continuously functions in a manner to generate a constant negative pressure. On the other hand, the valving mechanism 10 functions in a manner to keep the internal pressure of the ink container main structure 1 within the predetermined range only when the internal pressure of the ink container main structure 1 deviates from the predetermined range. Providing the ink container with a combination of two pressure regulating mechanisms different in properties makes it possible to synergistically use the functions of the two pressure regulating mechanisms to prevent the ink delivery performance from being affected by the changes in the factors in the environment of the ink container such as temperature, atmospheric pressure, vibrations, or the like, and therefore, ink can be stably supplied to the recording head.

As the recording head to which ink is supplied through the ink delivery tube 3, an ink jet recording head enabled to eject ink from its ink ejection orifices can be used. When employing such an ink jet recording head, the ink jet recording head and an ink container may be integrally formed, or the ink container may be formed as an ink jet cartridge, that is, a component independent from the recording head, which can be removably mountable in the ink jet recording apparatus. In the latter case, the valving mechanism 10 functions as a pressure regulating mechanism to prevent ink from leaking from the ink cartridge during the shipment of the ink cartridge. Also, a recording head which is provided with electrothermal transducers for generating thermal energy, and is enabled to eject ink by using the energy generated by the electrothermal transducer, may be used as the ink jet recording head.

As the material for the ink absorbing member 2 in this embodiment, fibrous material and porous material are preferred. The fibrous material can be created by piling, in a random crisscrossing manner, fibers of such a substance that is capable of forming a porous structure, for example, resin (cellulose, polypropylene, polyethylene, polyester, polyurethane, and the like), glass, or the like, whereas the foamed material can be created by foaming resin (polyethylene, polypropylene, siliconized resin, polyurethane, melamine, and the like), and removing walls of the pores in a manner to make the pores continuous.

Figure 5:
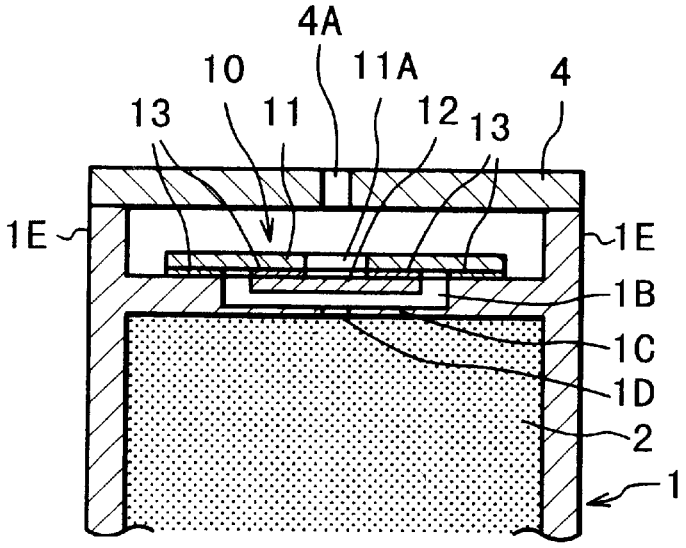
FIG. 5 is a sectional view of the essential portions of another valving mechanism different in structure from the valving mechanism in FIG. 1.

FIG. 5 is a drawing for describing the another structure for the valving mechanism in accordance with the present invention.

In the case of this structure, the hole 1B of the ink container main structure 1 has a circular bottom wall 1C, which has a center hole 1D. The internal pressure of the ink container main structure 1 acts on the valving mechanism 10 through this hole 1D. The valving mechanism 10 is protected by the wall portion 1E of the ink container main structure 1 and the cover 4 with a hole 4A. The atmospheric pressure works on the valving mechanism 10 through this hole 4A. Otherwise, the structure in this embodiment is the same as that in the first embodiment described above.

In this case, the valving mechanism 10 is protected by being surrounded by the wall portion 1E and cover 4, assuring that the valving mechanism 10 is prevented from coming in contact with the ink absorbing member 2 and the external peripheral components of the ink container main structure 1; it is assured that the valving mechanism 10 properly functions.

Figure 6:
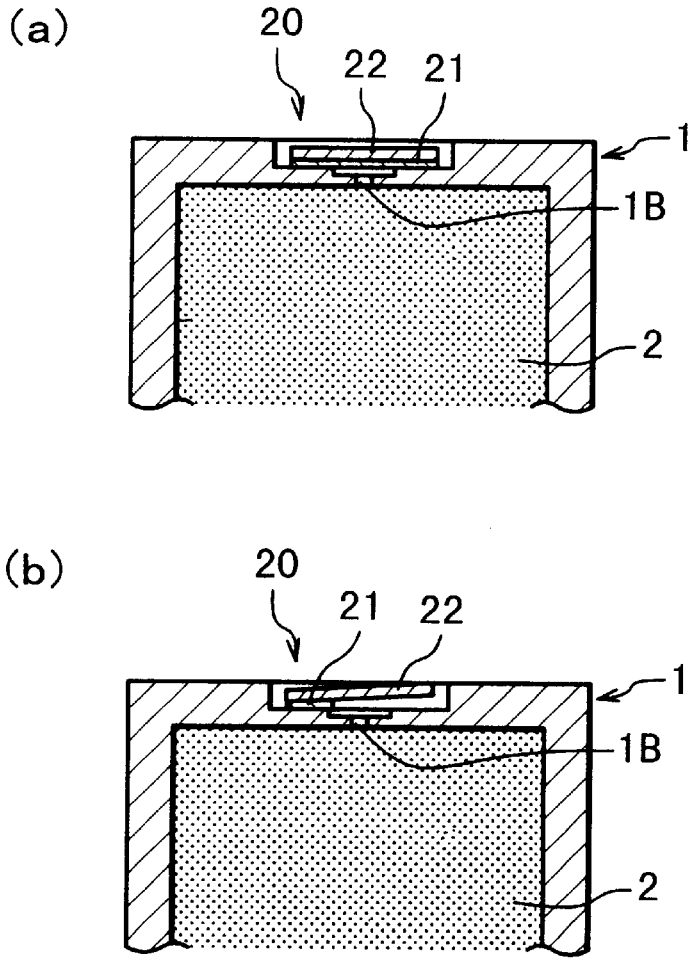
FIGS. 6(*a*) and 6(*b*) are sectional views of another valving mechanism different in structure from the preceding valving mechanisms, for describing the operation thereof.

FIGS. 6(*a*) and 6(*b*) are drawings for describing the structure of another valving mechanism in accordance with the present invention.

In this case, the hole 1B of the ink container main structure 1 is fitted with a one-way valving mechanism 20 as a pressure regulating means. The valving mechanism 20 comprises a Mylar sheet 22, which is positioned in contact with the outward fringe of the hole 1B to block or unblock the hole 1B, being coated with the sealing liquid 21 such as silicon oil. As the internal pressure of the ink container main structure 1 falls below a predetermined level, the Mylar sheet 22 moves to the closed position, at which it remains airtightly in contact with the outward fringe of the hole 1*b*, with the interposition of the sealing liquid 21, blocking the hole 1B as shown in FIG. 6(*a*), whereas as the internal pressure of the ink container main structure 1 exceeds the predetermined level, the Mylar film 22 partially and elastically deforms to create a gap through the sealing liquid 21, releasing the excessive pressure within the ink container main structure 1 into the atmosphere.

Thus, in the case of this structure, the increase in the internal pressure of the ink container main structure 1 is kept below the predetermined level by the valving mechanism 20. As a result, the unstable ink delivery, ink leakage, and the like, for which abnormal increase in the internal pressure of the ink container main structure 1 is responsible, can be prevented.

Figure 7:
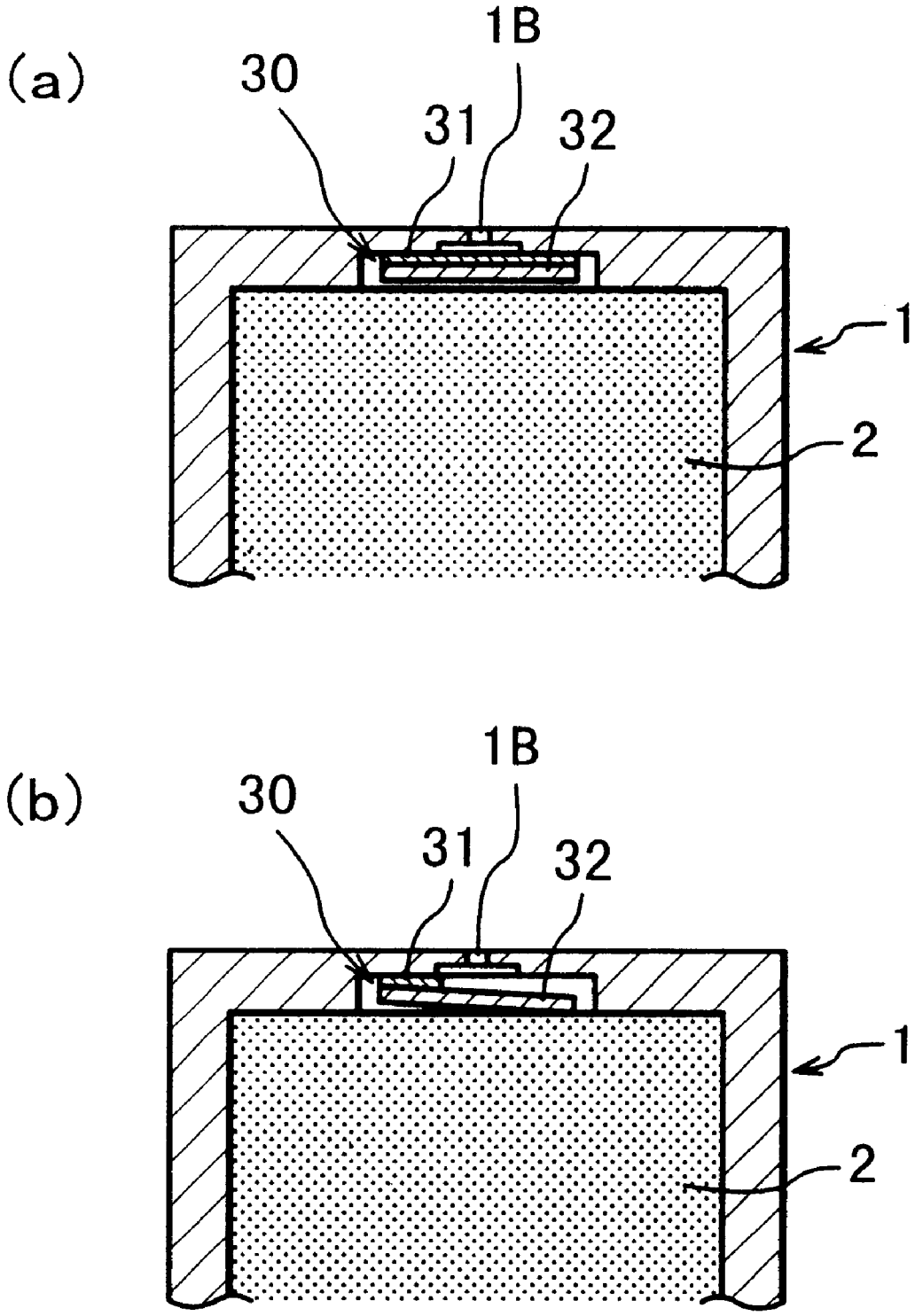
FIGS. 7(*a*) and 7(*b*) are sectional views of another valving mechanism different in structure from the preceding valving mechanisms, for describing the operation thereof.

FIGS. 7(*a*) and 7(*b*) are drawings for describing another valving mechanism structure in accordance with the present invention.

In this case, the hole 1B of the ink container main structure 1 is fitted with a one-way valving mechanism 30 as a pressure regulating means. The valving mechanism 30 comprises a Mylar sheet 32, which is coated with sealing liquid 31 such as silicon oil or the like and is placed on the inward side of the hole 1B in a manner to block the hole 1B. When the internal pressure of the ink container main structure 1 exceeds a predetermined level, the Mylar sheet 32 airtightly contacts the fringe of the inward side of the hole 1B, with the interposition of the sealing liquid 31, blocking the hole 1B, as shown in FIG. 7(*a*), whereas as the internal pressure of the ink container main structure 1 falls below the predetermined level, the Mylar sheet 32 partially and elastically deforms, creating a passage through the sealing liquid 31 so that the atmospheric air is introduced into the ink container main structure 1.

Thus, also in the case of this structure, the internal pressure of the ink container main structure 1 is kept above the predetermined level by the valving mechanism 30 to prevent the unstable ink delivery for which an abnormal drop in the internal pressure of the ink container main structure 1 is responsible.

The ink container main structure 1 may be provided with both the valving mechanisms 20 and 30 shown in FIGS. 6 and 7, respectively, so that the two valving mechanisms 20 and 30 work in coordination as a single two-way valving mechanism like the one in the first embodiment.

Figure 8:
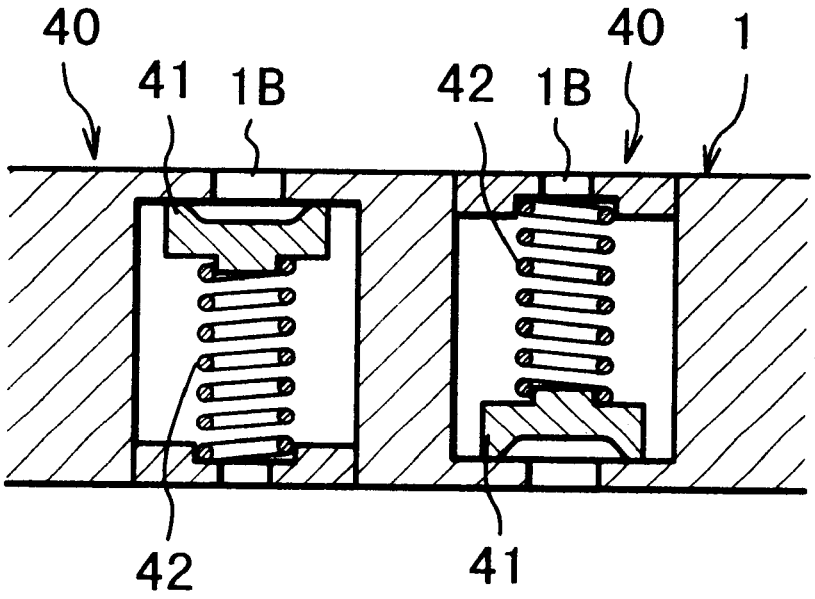
FIG. 8 is a sectional view of another valving mechanism different in structure from the preceding valving mechanisms.

FIG. 8 is a drawing for describing another valving mechanism structure in accordance with the present invention.

In this case, the ink container main structure 1 is provided with two one-way valving mechanisms 40, as pressure regulating means, which are opposite in directionality. More specifically, in the left valving mechanism 40 in FIG. 8, the valve 41 moves downward against a spring 42 to introduce the atmospheric air into the ink container main structure 1 through the hole 1B as the internal pressure of the ink container main structure 1 falls below a predetermined level. On the contrary, in the right valving mechanism 40 in FIG. 8, the valve 41 moves upward against a spring 42 to release the internal pressure of the ink container main structure 1 into the atmosphere through the hole 1B as the internal pressure of the ink container main structure 1 exceeds the predetermined level.

Figure 9:
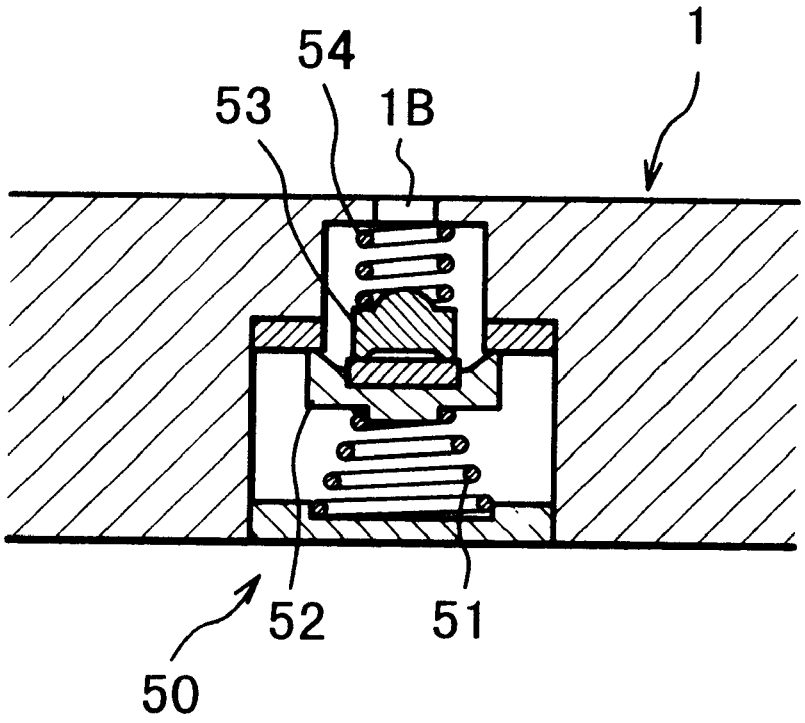
FIG. 9 is a sectional view of another valving mechanism different in structure from the preceding valving mechanisms.

FIG. 9 is a drawing for describing another valving mechanism structure in accordance with the present invention.

In this case, the ink container main structure 1 is provided with a two-way valving mechanism 50 as a pressure regulating means which comprises two one-way valving mechanisms joined in series in a manner to work in the opposing directions. More specifically, as the internal pressure of the ink container main structure 1 on the bottom side in FIG. 9 falls below a predetermined level, a first valve 51 moves downward against a first spring 52 to allow the atmospheric air to be introduced into the ink container main structure 1 through the hole 1B. On the other hand, as the internal pressure of the ink container main structure 1 exceeds the predetermined level, a second valve 53 moves upward against a second spring 54 to allow the internal pressure of the ink container main structure 1 to be released into the atmosphere through the hole 1B.

Figure 10:
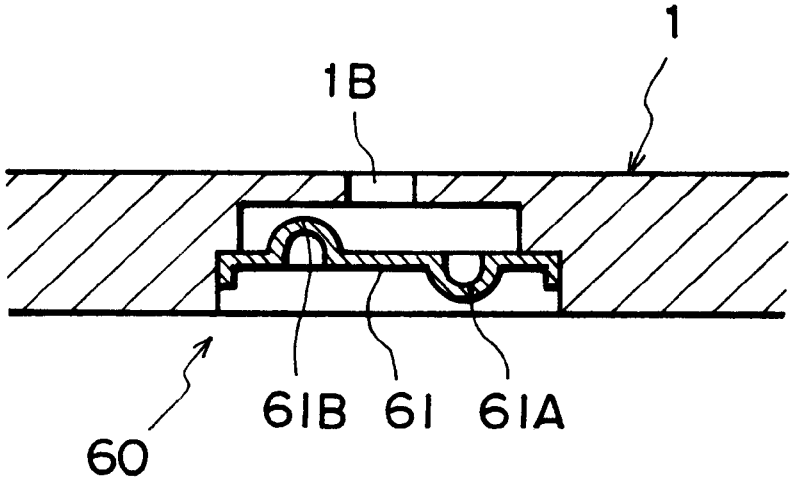
FIG. 10 is a sectional view of another valving mechanism different in structure from the preceding valving mechanisms.

FIG. 10 is a drawing for describing another valving mechanism in accordance with the present invention.

In this case, the ink container main structure 1 is provided with a two-way valving mechanism 60 as a pressure regulating means. The valving mechanism 60 comprises an elastic member 61, which is formed of rubber or the like and is placed in a manner to block the hole 1B. The elastic member 62 has two slits 61A and 61*b*. As the internal pressure of the ink container main structure 1 on the bottom side in FIG. 10 falls below a predetermined level, the slit 61A opens to allow the atmospheric air to be introduced into the ink container main structure 1 through the hole 1B. On the other hand, as the internal pressure of the ink container main structure 1 rises above the predetermined level, the slit 61B opens to allow the internal pressure of the ink container main structure 1 to be released into the atmosphere.

Figure 11:
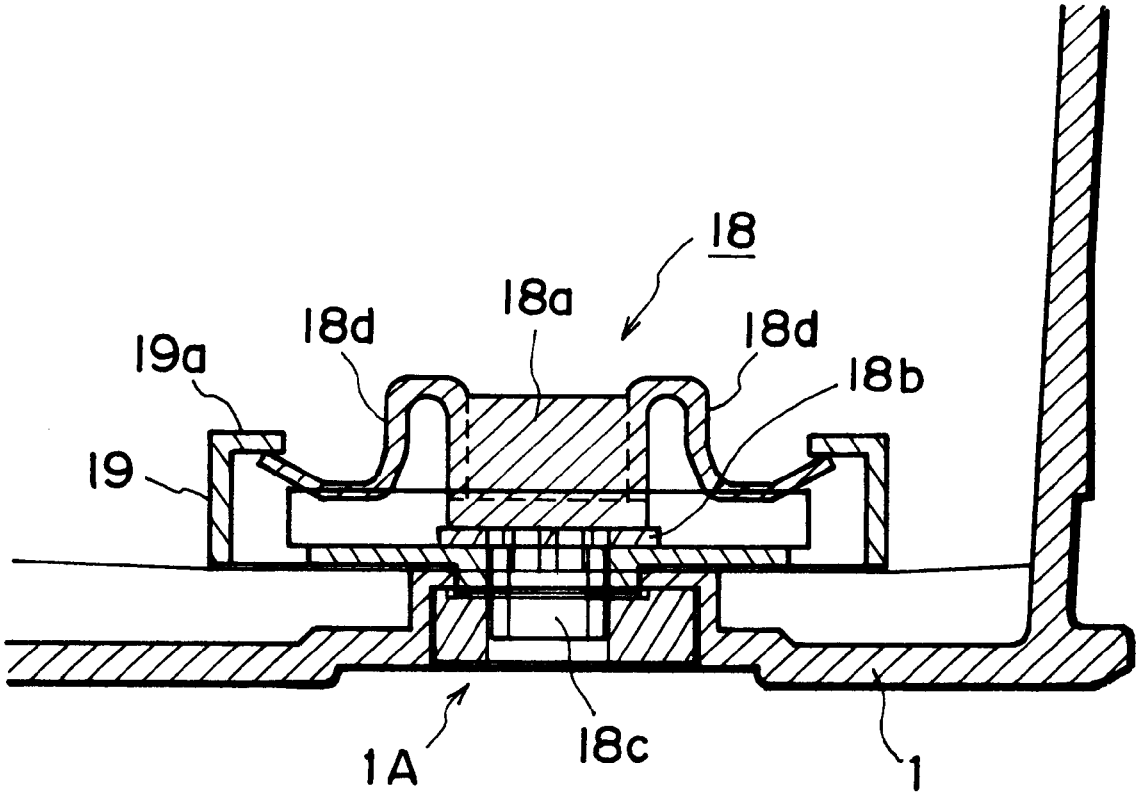
FIG. 11 is a sectional view of another valving mechanism different in structure from the preceding valving mechanisms.

FIG. 11 is an enlarged sectional view of another valving mechanism 18 different in structure from the preceding ones, along with the ink delivery hole 1A and its adjacencies of the ink container main structure 1.

Figure 4:
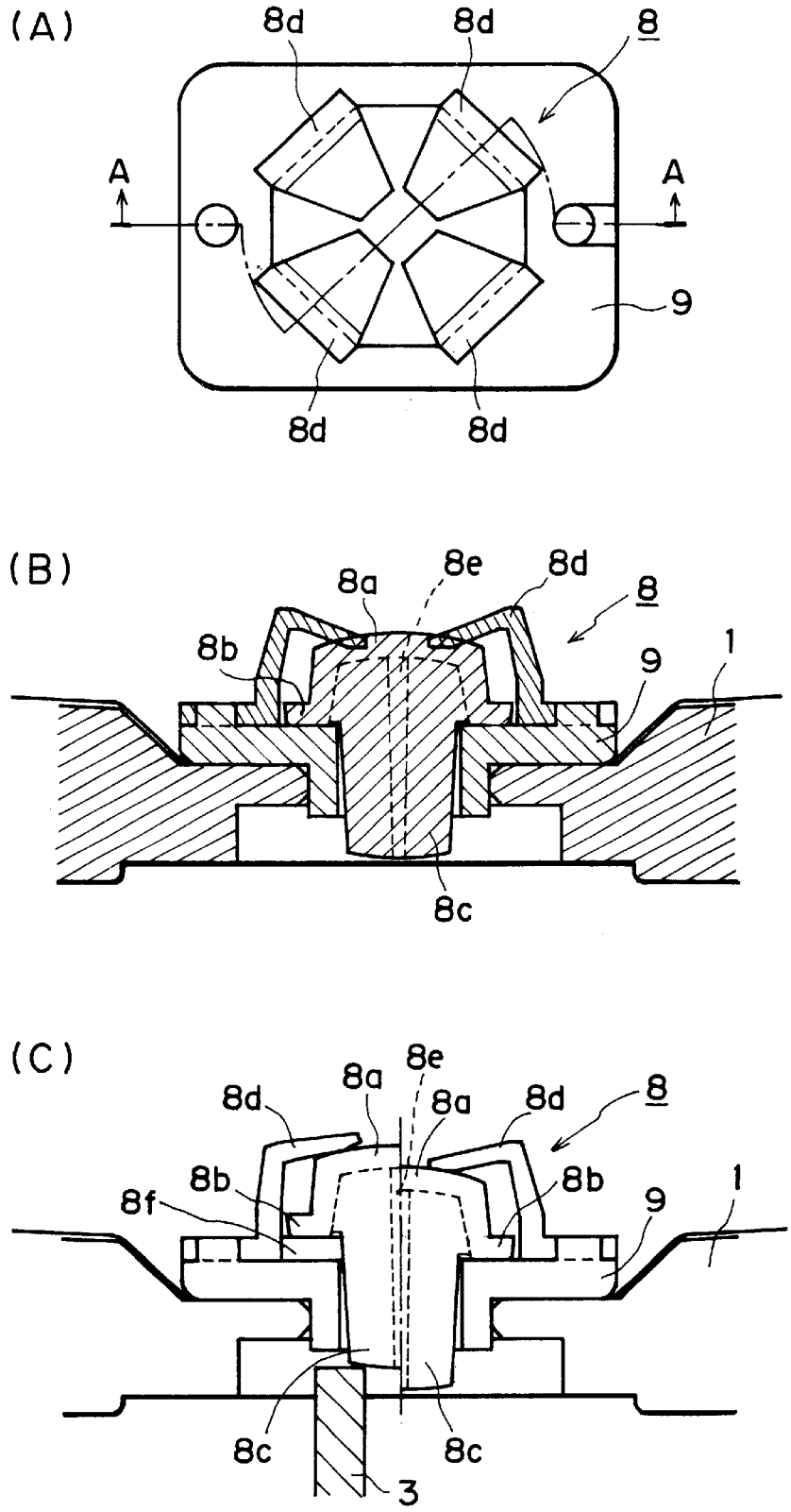
FIGS. 4(A), 4(B), and 4(C) are drawings for describing the structure and operation of the valve in FIG. 1.

The basic structure of this valving mechanism 18 is the same as that of the valving mechanism 8 shown in FIG. 4. In other words, the valving mechanism 18 has a valve 18*a* comprising a valve head 18*b* for covering the opening of the ink delivery hole 1A, a valve stem 18*c* which extends from the valve head 18*b* outward of the ink container. However, this valving mechanism 18 is different from the valving mechanism 8 in that this valving mechanism 18 does not have a plurality of independent elastic pressing members like those for the valving mechanism 8 shown in FIG. 4, and instead, it is provided with a plurality of elastic pressing members 18*d* which are integral parts of the valve 18*a*, and that the valve seat 19 of this valving mechanism 18 is provided with a plurality of elastic pressing member seating areas 19*a*, on each of which the end of the corresponding elastic pressing member 18*d* is seated. Each elastic pressing member 18*d* is bent in such a manner that as it is seated against the corresponding elastic pressing member seating area 19*a*, it generates such force that works in the direction to press the valve head 18*b* toward the ink delivery hole 1A.

If the valve head 18*b* does not properly seat on the valve seat 19, it is possible for ink to leak. Therefore, it is desired that the valve seat 19 is provided with a circular rib (unshown) which is positioned in a manner to surround the fringe of the opening of the ink delivery hole 1A to assure that the interface between the valve head 18*b* and valve seat 19 is airtightly sealed. If the valve 18*a* (in particular, the valve head 18*b*) is easily deformable, it is possible for ink to accidentally leak. Therefore, the valve 18*a* is desired to be formed of hard material. In order to improve the reliability of the rib of the valve seat 19 and the valve head 18*b* formed of the aforementioned hard material in terms of the airtightness across their interface, it is desirable that the portion of the valve head 18*b*, which comes into contact with the rib, is formed of an elastic material such as EVA, urethane rubber, silicone rubber, or the like. In this case, the elastic material is backed by the hard material portion of the valve head 18*b*, and therefore, it does not accidentally deform; it can be used as a reliable material to seal between the rib and valve head 18*b*.

A single component having a portion formed of hard material and a portion formed of elastic material can be easily produced using one of the widely known technologies, for example, a two color molding technology.

(Embodiment 2)

Figure 12:
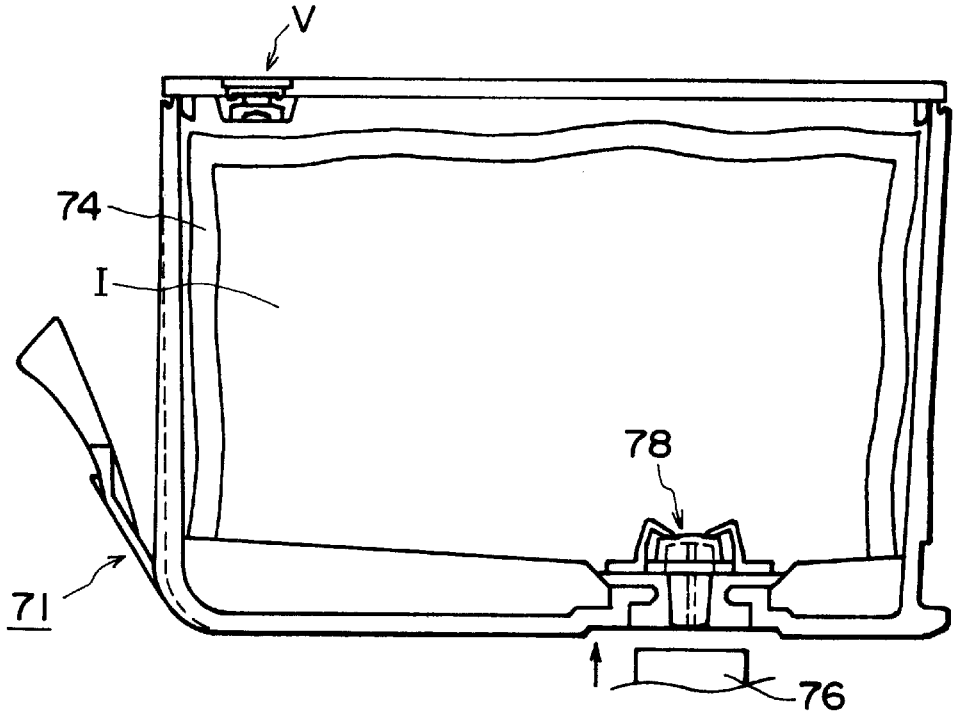
FIG. 12 is a sectional view of the ink container in the second embodiment of the present invention.

FIG. 12 is a drawing for describing the second embodiment of the present invention.

In this case, the ink container main structure 71 is provided with an ink pouch 74 as an ink storing member, which is located within the ink container main structure 71. The ink pouch 74 holds ink without pressurizing the ink 1 therein. The ink pouch 74 may be formed of elastic material so that it generates a predetermined amount of internal pressure. The fringe of the ink delivery hole of the ink pouch 74 is connected to the ink delivery hole 71A of the ink container main structure 1, with the interposition of a valving mechanism 78. An ink delivery tube 76 is inserted into the valving mechanism 78 from the direction indicated by an arrow mark to supply the ink 1 within the ink pouch 74 to a recording head.

The ink pouch 74 may be made by folding a resin sheet in half and welding the three edges. In such a case, the valving mechanism 78 is attached to the bent portion of the thus formed ink pouch 74, and then, the valving mechanism 78 is attached to the ink delivery hole 71A of the ink container main structure 71, to produce an ink container.

Incidentally, the valving mechanism 78 shown in FIG. 12 is the same in structure as the valving mechanism described with reference to FIG. 4. However, it is obvious that a valving mechanism having the same structure as the valving mechanism described with reference to FIG. 11 may be used in place of the valving mechanism 78.

An ink container structured as described above can regulate the internal pressure of the ink container main structure 71 to supply ink as stably as those ink containers described above, being assisted by the ink pouch 74 as an ink storing member, the valving mechanism V, and the valving mechanism 78, which work in coordination.

(Embodiment 3)

Figure 13:
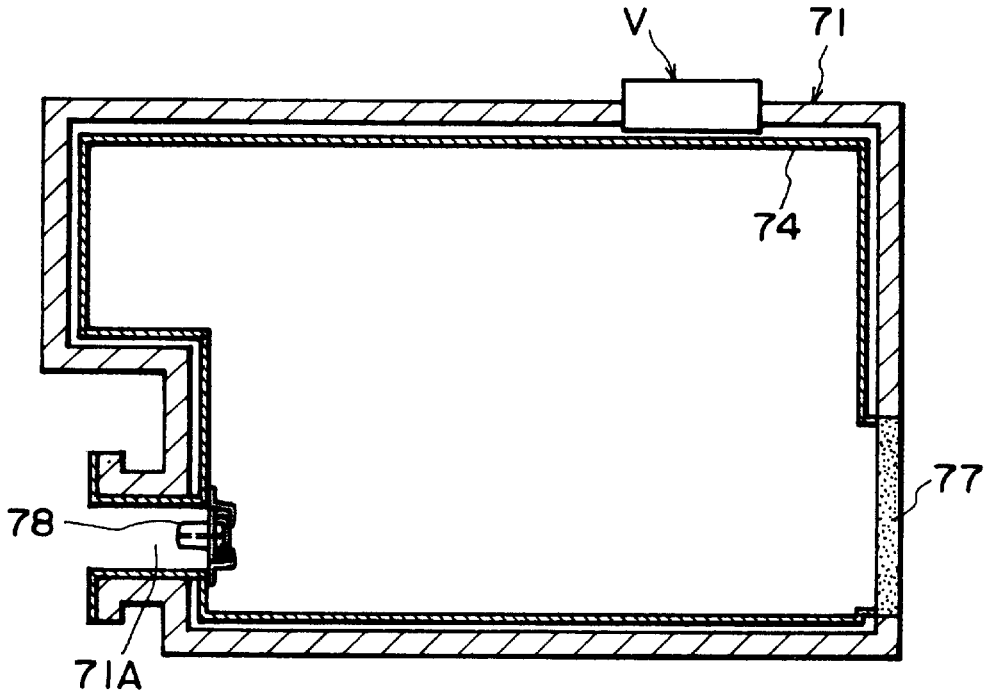
FIG. 13 is a sectional view of the ink container in the third embodiment of the present invention.

FIG. 13 is a drawing for describing the third embodiment of the present invention.

In this case, the ink container is given a double-wall structure; the ink container comprises an ink container main structure 71 and an ink pouch 74, which are blow-molded of a resinous material for the ink container main structure 71 and a resinous material for the ink pouch 74, respectively. More specifically, the ink container main structure 71 which is comparable to the external wall of the ink container is formed thick for strength, whereas the ink pouch 74 which is comparable to the internal wall of the ink container is formed thin for flexibility. The resinous materials selected for their suitability for the external and internal wall materials are blow-molded together into the ink container main structure 71 and ink pouch 74. The ink container main structure 71 and ink pouch 74 are separated after the molding; the external and internal walls can be separated by suctioning air out of the space within the internal wall, or by thermal deformation. As ink is delivered out of the ink pouch 74 blow-molded of the resinous material, the ink pouch 74 deforms in such a manner that the opposing two walls of the ink pouch 74 with the largest size gradually approach each other, while the walls of the ink pouch 74 adjoining the largest two walls of the ink pouch 74 and the corner portions of the ink pouch 74 serve as portions for regulating the deformation. Thus, the ink pouch 74 itself formed of resinous material can be made to function as a negative pressure generation source capable of a predetermined amount of negative pressure, by selecting the thickness and material for the internal wall, or the ink pouch wall.

A referential code 77 designates the portion of the ink container across which the external and internal resinous walls of the ink container have been welded to each other, and a referential code 78 designates a valving mechanism fitted within the ink delivery hole 71A. As an unshown ink delivery tube is pressed against the valving mechanism 78, or an ink delivery permitting member, the ink delivery hole 71A having been blocked by a valve is unblocked to allow the ink 1 within the ink container main structure 71 to be supplied to a recording head. The ink container main structure 71 is also provided with a valving mechanism V, such as the aforementioned various valving mechanisms, which constitutes a pressure regulating means.

An ink container structured as described above can regulate the internal pressure of the ink container main structure 71 to supply ink as stably as those ink containers described above, being assisted by the ink pouch 74 as an ink storing member, the valving mechanism V, and the valving mechanism 78, which work in coordination.

Incidentally, the valving mechanism 78 shown in FIG. 13 is the same in structure as the valving mechanism described with reference to FIG. 4. However, it is obvious that a valving mechanism having the same structure as the valving mechanism described with reference to FIG. 11 may be used in place of the valving mechanism 78.

(Embodiment 4)

Figure 14:
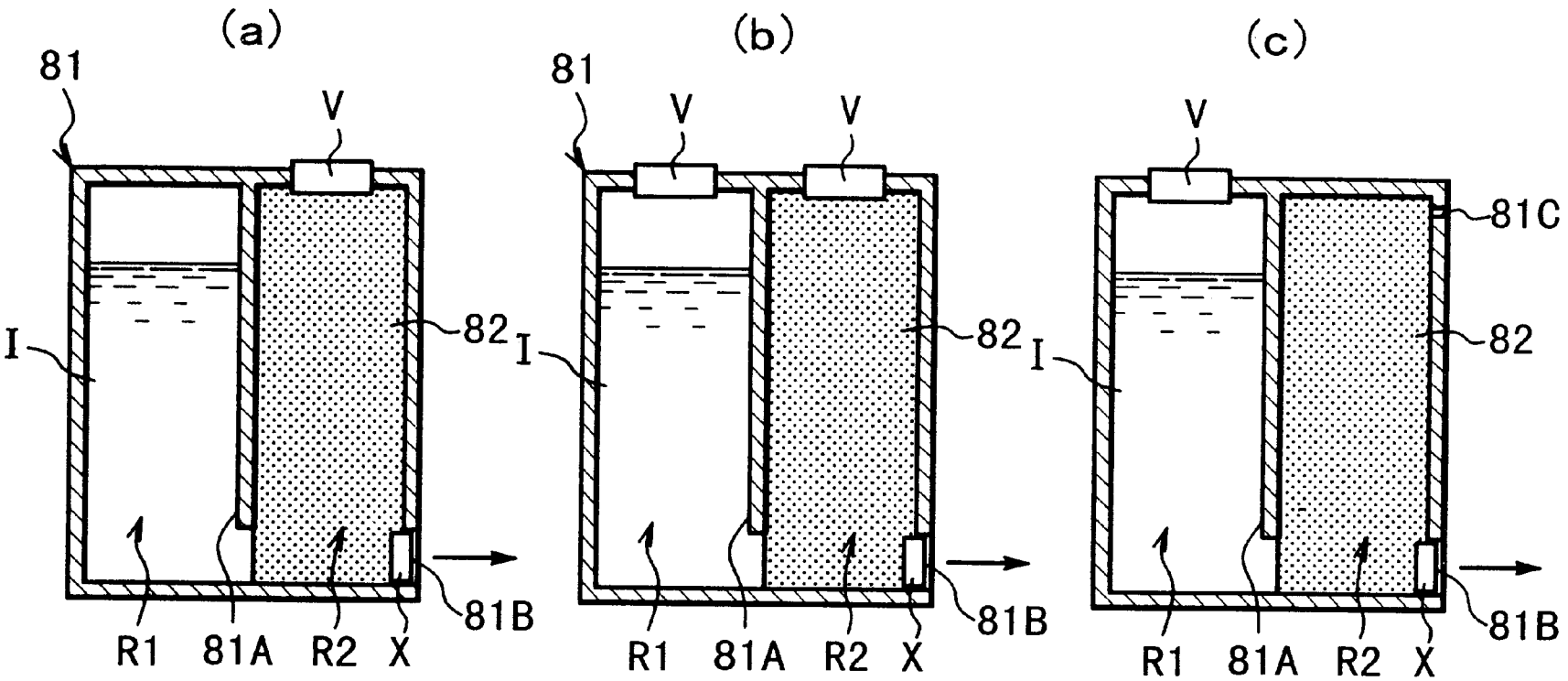
FIGS. 14(*a*), 14(*b*), and 14(*c*) are sectional views of another ink container in accordance with the present invention, more specifically, an ink container with two ink chambers, for describing another application of the present invention different from the preceding ones.

FIGS. 14(*a*), 14(*b*), and 14(*c*) are drawings for describing embodiments of the present invention, which are different from the preceding embodiments in that the ink container main structure 81 has two separate ink chambers.

In these cases, the internal space of the ink container main structure 81 is divided by a partitioning wall 81A into first and second ink chambers R1 and R2, the internal spaces of which are mutually connected. The ink delivery hole 81A of the ink container main structure 81 is connected to the second ink chamber R2, in which a porous ink absorbing member 82 as an ink retaining member for absorbing and retaining ink, is disposed. Within the first ink chamber R1, ink 1 is directly stored, whereas within the second ink chamber R2, the ink 1 is absorbed and retained by the ink absorbing member 82. The ink delivery hole 81B is provided with a valving mechanism X such as those shown in FIGS. 4 and 11, although its detailed structure is not shown here.

In the case of the ink container shown in FIG. 14(*a*), one of the walls of the second ink chamber R2 of the ink container main structure 81 is provided with an unshown hole as an air vent, which is fitted with a two-way or one-way valving mechanism V, such as the aforementioned various valving mechanisms, which constitutes a pressure regulating means. In this ink container, the internal pressure of the ink container main structure 81 is regulated by the valving mechanism V on the second ink chamber R2 side, while the presence of the valving mechanism X prevents ink leakage, so that the ink 1 is stably supplied in the direction indicated by an arrow mark.

In the case of the ink container shown in FIG. 14(*b*), one of the walls of the first ink chamber R1 of the ink container main structure 81 is provided with an unshown hole in addition to the structural arrangement shown in FIG. 14(*a*). This hole is fitted with a two-way or one-way valving mechanism V, such as the aforementioned various valving mechanisms, which constitutes a pressure regulating means. In this ink container, the internal pressure of the ink container main structure 1 is regulated by the valving mechanism V of the first ink chamber R1 and the valving mechanism V of the second ink chamber R2, while preventing ink leakage with the presence of the valving mechanism X, so that the ink 1 can be stably supplied in the direction indicated by an arrow mark.

In the case of the ink container shown in FIG. 14(*c*), one of the walls of the first ink chamber R1 of the ink container main structure 81 is provided with an unshown hole, which is fitted with a two-way or one-way valving mechanism V, such as the aforementioned various valving mechanisms, which constitutes a pressure regulating mechanism. Further, one of the walls of the second ink chamber R2 of the ink container main structure 81 is provided with an air venting hole 81. In this ink container, the internal pressure of the ink container main structure 81 is regulated by the valving mechanism V on the first ink chamber R1 side, while preventing ink leakage with the presence of the valving mechanism X, so that ink is more stably supplied in the direction indicated by an arrow mark.

Further, since the internal pressure of the ink container main structure 81 is regulated by the valving mechanism V on the first ink chamber R1 side, even if the internal volume of the ink chamber R2 is reduced, the ink 1 can be stably supplied. The amount of the ink storable in the second ink chamber R2 is reduced by the amount equivalent to the internal volume of the second ink chamber R2 necessary for the placement of the ink absorbing member 82. Thus, being able to reduce the volume of the ink absorbing member 82 means being able to increase, in relative terms, the internal volume of the first ink chamber R1 in order to increase the ink capacity of the first ink chamber R1.

Also, in the cases of the ink containers in FIGS. 14(*b*) and 14(*c*), the expansion or contraction of the ink depleted portion of the internal space of the first ink chamber R1 caused by the changes in the ambient pressure is regulated, and therefore, the ink flow into, or out of, the second ink chamber R2 is controlled. As a result, ink is prevented from leaking out of the ink delivery hole 81B. Since the ink flow into, or out of, the second ink chamber R2 is controlled as described above, an ink buffer portion which the second ink chamber R2 conventionally required can be reduced in size; in other words, the volumetric efficiency of the ink container (volume of usable ink relative to total internal volume of ink container) is improved.

(Embodiment 5)

Figure 15:
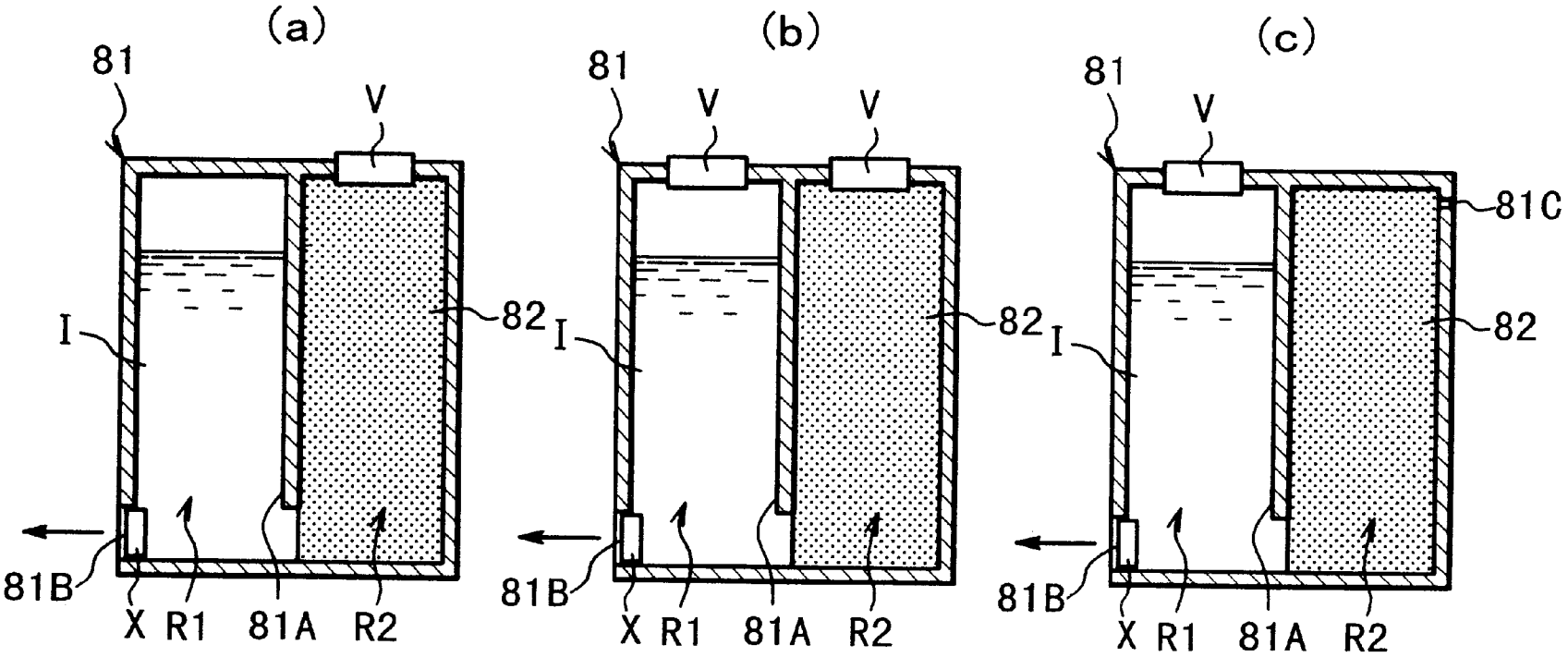
FIGS. 15(*a*), 15(*b*), and 15(*c*) are sectional views of another ink container in accordance with the present invention, more specifically, an ink container with two ink chambers, for describing another application of the present invention different from the preceding ones.

FIGS. 15(*a*), 15(*b*), and 15(*c*) are drawings for describing applications of the present invention different from the preceding applications in that the internal space of the ink container main structure 81 is divided into two chambers.

In these applications, the ink container main structure 81 has a partitioning wall 81A which divides the internal space of the ink container main structure 81 into first and second ink chambers R1 and R2, the internal space of which are connected to each other. The ink delivery hole 81B of the ink container main structure 81 is connected to the first ink chamber R1. Within the second ink chamber R2, a porous ink absorbing member 82 as an ink retaining member which absorbs and retains ink is disposed. Within the first ink chamber R1, ink 1 is directly stored, whereas in the second ink chamber R2, the ink 1 is retained by the ink absorbing member 82 which retains the ink 1 by absorbing it. The ink delivery hole 81B is fitted with a valving mechanism X such as those described with reference to FIGS. 4 and 11, although its concrete structure is not shown here.

In the case of the application shown in FIG. 15(*a*), one of the walls of the second ink chamber R2 of the ink container main structure 81 is provided with an unshown hole as an air vent, which is fitted with a two-way or one-way valving mechanism V, such as the aforementioned various valving mechanisms, which constitutes a pressure regulating means. In this ink container, the internal pressure of the ink container main structure 81 is regulated by the valving mechanism V on the second ink chamber R2 side, while preventing ink leakage with the presence of the valving mechanism X, so that the ink is stably supplied in the direction indicated by an arrow mark.

In the case of the application shown in FIG. 15(*b*), in addition to being structured as shown in FIG. 15(*a*), one of the walls of the second ink chamber R1 of the ink container main structure 81 is provided with an unshown hole, which is fitted with a two-way or one-way valving mechanism V, such as the aforementioned various valving mechanisms, which constitutes a pressure regulating means. In this ink container, the internal pressure of the ink container main structure 81 is regulated by the valving mechanism V on the first ink chamber R1 side and the valving mechanism V on the second ink chamber R2, while preventing ink leakage with the presence of the valving mechanism X, so that the ink is stably supplied in the direction indicated by an arrow mark.

In the case of the application shown in FIG. 15(*c*), one of the walls of the first ink chamber R1 of the ink container main structure 81 is provided with an unshown hole as an air vent, which is fitted with a two-way or one-way valving mechanism V, such as the aforementioned various valving mechanisms, which constitutes a pressure regulating means. Further, the one of the walls of the second ink chamber R2 of the ink container main structure 81 is provided with an air venting hole 81C. In this ink container, the internal pressure of the ink container main structure 81 is regulated by the valving mechanism V on the first ink chamber R1 side so that the ink is stably supplied in the direction indicated by an arrow mark while preventing ink leakage with the presence of the valving mechanism X.

Further, since the internal pressure of the ink container main structure 81 is regulated by the valving mechanism V on the first ink chamber R1, the ink can be stably supplied even if the internal volume of the second ink chamber R2 is reduced. Since the ink capacity of the second ink chamber R2 is reduced by the placement of the ink absorbing member 82 in the second ink chamber R2, reducing the volume of the second ink chamber R2 results in increase in the volume of the first ink chamber R1, increasing thereby the overall ink capacity of the ink container.

In the cases of the applications shown in FIGS. 15(*a*) and 15(*b*), the expansion or contraction of the ink depleted portion of the internal space of the second ink chamber R2 created by the ink consumption, caused by the fluctuation in the ambient pressure, is regulated, and therefore, the ink flow into, or out of, the first ink chamber R1 is controlled. As a result, ink is prevented from leaking from the ink delivery hole 81B. In other words, in the cases of the applications shown in FIGS. 15(*a*) and 15(*b*), the ink flow into, or out of, the ink chamber R1 is controlled as described above, it is possible to improve the volumetric efficiency of the ink container (ratio of usable volume of ink relative to ink container volume) by reducing an ink buffer portion which is conventionally necessary in the first ink chamber R1.

(Embodiment 6)

Figure 16:
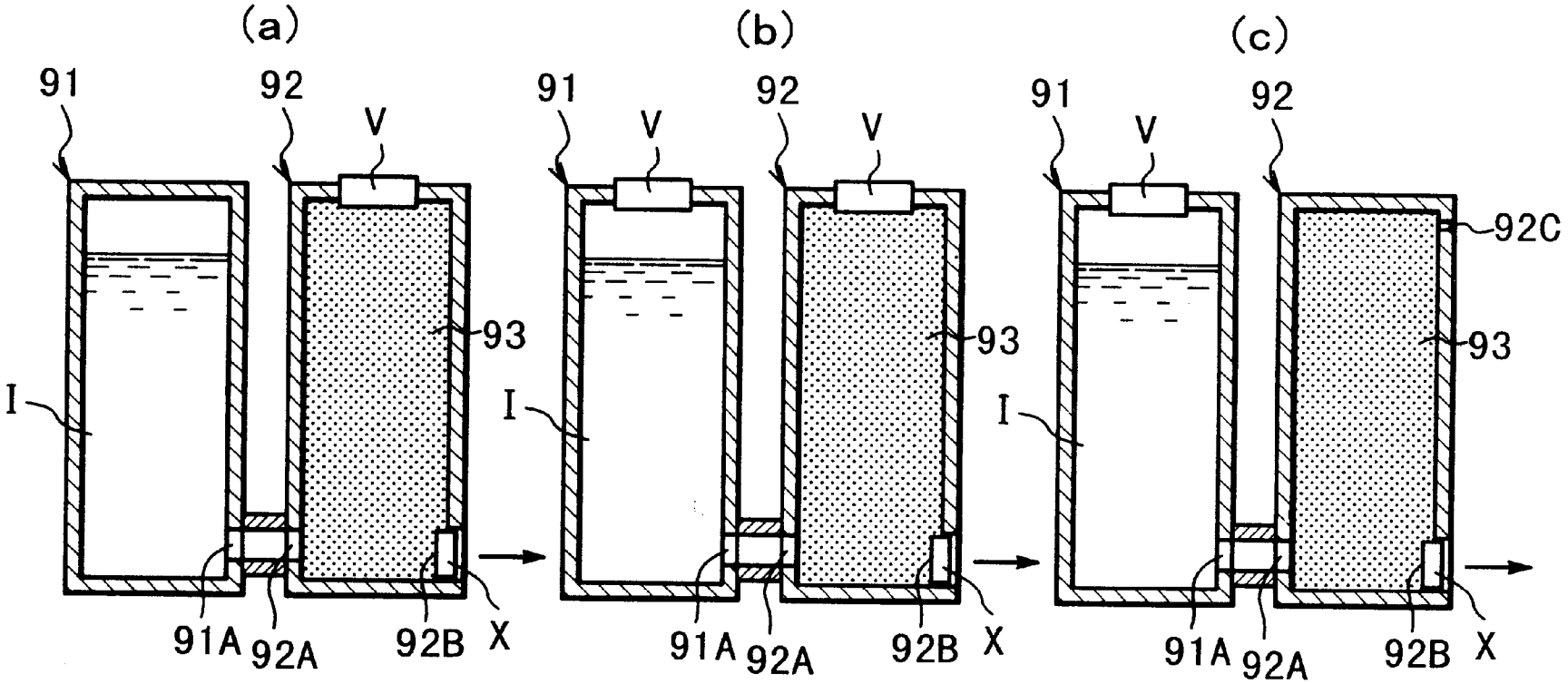
FIGS. 16(*a*), 16(*b*), and 16(*c*) are sectional views of another ink container in accordance with the present invention, more specifically, an ink container with two ink chambers separable from each other, for describing another application of the present invention different from the preceding ones.

FIGS. 16(*a*), 16(*b*), and 16(*c*) are drawings for describing applications of the present invention to ink containers which comprise two separable main structures, and is different from the ink containers described before.

In these applications, the two structures, that is, the first and second ink container main structures 91 and 92, are separably connected to each other at the connecting holes 91A and 91B, respectively. The second ink container main structure 92 is provided with an ink delivery hole 92B, and within the ink chamber of this ink container main structure 92, a porous ink absorbing member 93 as an ink retaining member, which absorbs and retains ink, is disposed. Within the ink chamber of the first ink container main structure 91, ink 1 is directly stored, whereas within the second ink container main structure 92, ink 1 is retained by being absorbed in the ink absorbing member 93. The ink delivery hole 91B is fitted with the valving mechanism X such as those shown in FIGS. 4 and 11, although its concrete structure is not shown here.

In the case of the application shown in FIG. 16(*a*), the second ink container main structure 92 is provided with an unshown hole as an air vent, which is fitted with a two-way or one-way valving mechanism V, such as the aforementioned various valving mechanisms, which constitutes a pressure regulating means. In this ink container, the internal pressures of the ink container main structures 91 and 92 are regulated by the valving mechanism V on the second ink container main structure 92 side, while preventing ink leakage with the presence of a valving mechanism X, so that the ink is more stably supplied in the direction indicated by an arrow mark.

In the case of the application shown in FIG. 16(*b*), in addition to being given the structure shown in FIG. 16(*a*), the first ink container main structure 91 is provided with an unshown hole, which is fitted with a two-way or one-way valving mechanism, such as the aforementioned valving mechanism, which constitutes a pressure regulating means. In this ink container, the internal pressures of the ink container main structures 91 and 92 are regulated by the valving mechanism V on the first ink container main structure 91 side and the valving mechanism 92 on the second ink container main structure 92 side, while preventing ink leakage with the presence of a valving mechanism X, so that ink is more stably supplied in the direction indicated by an arrow mark.

In the case of the application shown in FIG. 16(*c*), the first ink container main structure 91 is provided with an unshown hole, which is fitted with a valving mechanism, such as the aforementioned various valving mechanisms, which constitutes a pressure regulating means. Further, the second ink container main structure 92 is provided with an air vent 92C. In this ink container, the internal pressures of the ink container main structures 91 and 92 are regulated by the valving mechanism V on the first ink container main structure 91 side so that ink is more stably supplied in the direction indicated by an arrow mark. Since the internal pressures are regulated by the valving mechanism V on the first ink container main structure 91, ink can be stably supplied even if the volume of the second ink container main structure 92 is reduced. Further, the ink capacity of the second ink container main structure 92 is reduced by the amount equivalent to the internal volume of the second ink container main structure 92 necessary for the placement of the ink absorbing member 93. Thus, affording reduction in the volume of the second ink container main structure 92 makes it possible to increase the overall ink capacity of this ink container by increasing the volume of the first ink container main structure 91 relative to the volume of the second ink container main structure 92.

In the cases of the applications shown in FIGS. 16(*b*) and 16(*c*), the expansion or contraction of the ink depleted portion of the internal space of the first ink container main structure 91, caused by the changes in the ambient pressure, is regulated, and the ink flow into, or out of, the second ink container main structure 92 is controlled, and therefore, ink is prevented from leaking from the ink delivery hole 92B. In other words, in the cases of the applications shown in FIGS. 16(*b*) and 16(*c*), the ink flow into, or out of, the second ink container main structure 92 is controlled, and therefore, an ink buffer portion which is conventionally required by the second ink container main structure 92 can be reduced in size. Therefore, it is possible to improve the volumetric efficiency of the ink container (volume of usable ink in ink container relative to ink container volume) by reducing the size of the ink buffer portion.

(Embodiment 7)

Figure 17:
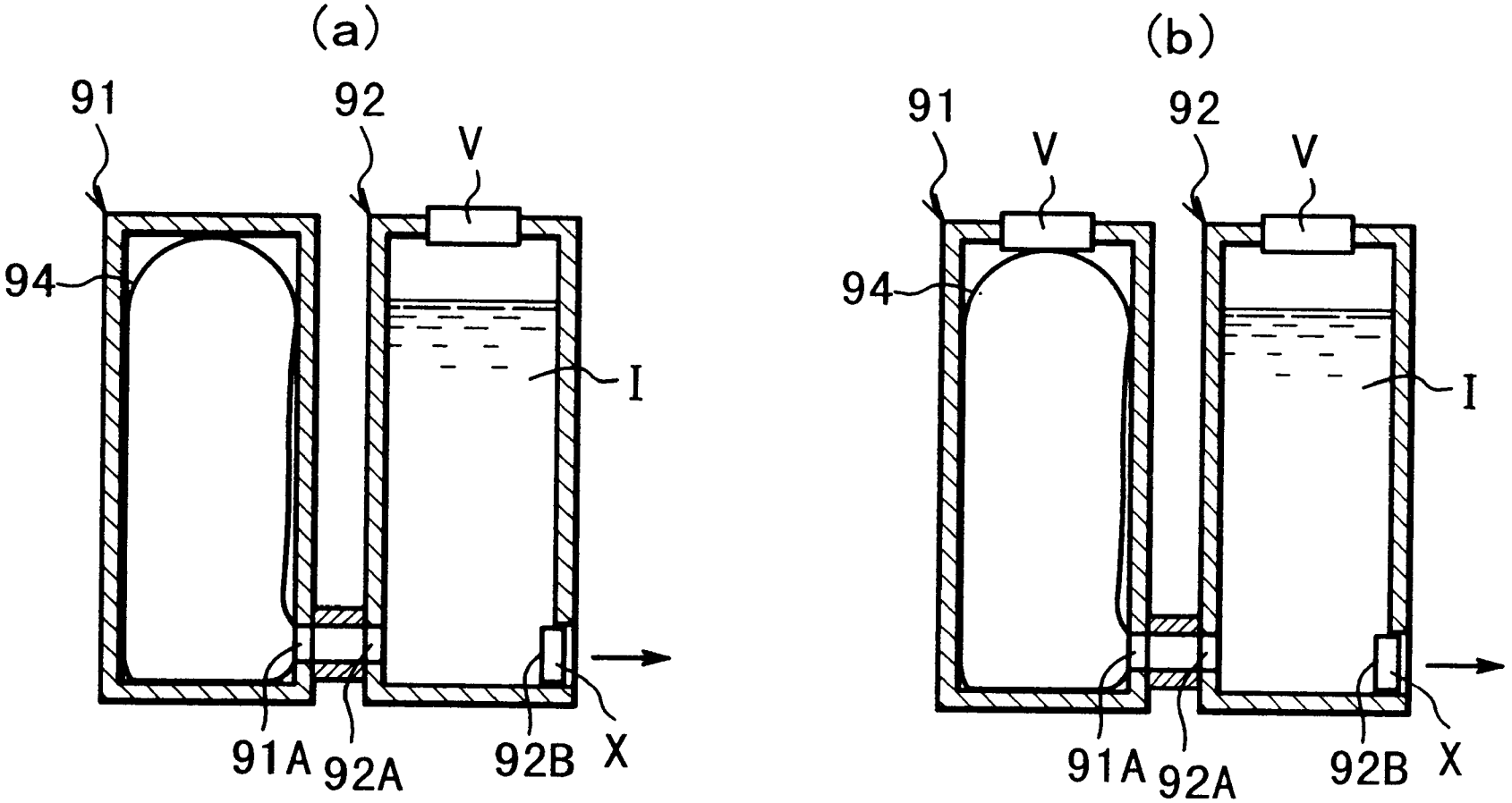
FIGS. 17(*a*) and 17(*b*) are sectional views of another ink container in accordance with the present invention, more specifically, an ink container with two ink chambers separable from each other, for describing another application of the present invention different from the preceding ones.

FIGS. 17(*a*) and 17(*b*) are drawings for describing additional cases in which the present invention is applied to an ink container comprising two ink container main structures which can be disconnected from each other.

In these cases, the two ink container main structures, or the first and second ink container main structures 91 and 92, are separably connected to each other at connective holes 91A and 92A, respectively. Within the ink chamber of the first ink container main structure 91, an elastic ink pouch 94, as an ink retaining member, for storing ink is disposed. The second ink container main structure 92 is provided with an ink delivery hole 92B. Within the first ink container main structure 91, ink 1 is held within the ink pouch 94, whereas in the ink chamber of the second ink container main structure 92, ink 1 is directly stored. The ink delivery hole 91B is fitted with a valving mechanism X such as those shown before in FIGS. 4 and 11, although its concrete structure is not shown here.

In the case shown in FIG. 17(*a*), the second ink container main structure 92 is provided with an unshown hole as an air vent, which is fitted with a two-way or one-way valving mechanism V, such as the above described various valving mechanisms, which constitutes a pressure regulating means. In this ink container, the internal pressures of the ink container main structure 92 and ink pouch 94 are regulated by the valving mechanism V on the second ink container main structure 92 side, with ink leakage being prevented by the presence of the valving mechanism X, so that ink is more stably supplied in the direction indicated by an arrow mark.

Further, since the internal pressures are regulated by the valving mechanism V on the second ink container main structure 92 side, ink can be stably supplied even if the volume of the first ink container main structure 91 is reduced. Further, since the ink capacity of the first ink container main structure 91 is reduced by the amount equivalent to the amount of the internal volume of the ink container main structure 91 reduced by the placement of the ink pouch 94, affording the reduction in the volume of the first ink container main structure 91 makes it possible to improve the overall ink capacity of the ink container by increasing the volume of the second ink container main structure 92 relative to the first ink container main structure 91.

In the case of the application shown in FIG. 17(*b*), in addition to being structured as shown in FIG. 17(*a*), the first ink container main structure 91 is provided with an unshown hole, which is fitted with a two-way or one-way valving mechanism V, such as the above described various valving mechanisms, which constitutes a pressure regulating means. In this ink container, the internal pressures of the first and second ink container main structures 91 and 92 are regulated by the valving mechanism V on the first ink container main structure 91 and the valving mechanism V on the second ink container main structure 92, while ink leakage is prevented by the presence of a valving mechanism X, so that ink is more stably supplied in the direction indicated by an arrow mark.

In each of the above described embodiments, it was assumed that the mounting of the ink container and the connection of the ink delivery tube occurred in parallel. However, in such a case that an ink container is mounted from diagonally above, through a rotational motion as shown in FIG. 18, the time when the end of the valve stem 18*c* of a valving mechanism 18 comes into contact with an ink delivery tube 3 does not concur with the time when the valving mechanism 18 engages with the ink delivery tube 3; in other words, it is possible that before a sealing member 3A fitted around the ink delivery tube 3 is placed airtightly in contact with the ink container, the valving mechanism 18 is opened as shown in FIG. 18, which leads to ink leakage.

Figure 18:
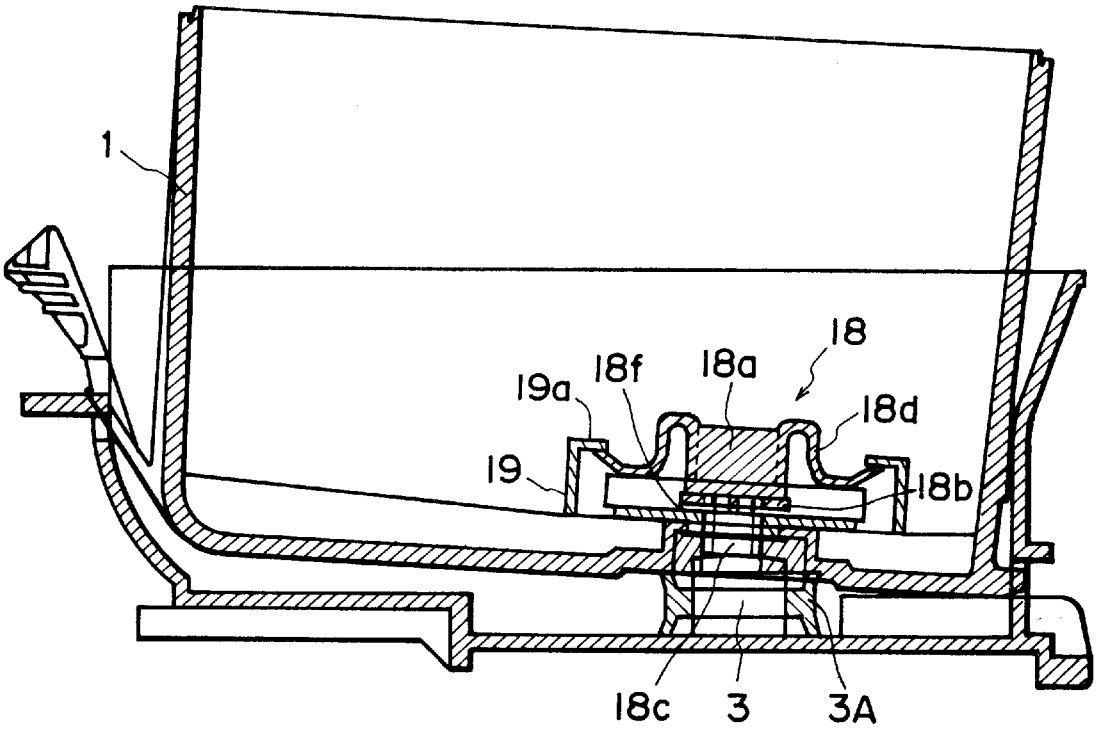
FIG. 18 is a drawing for describing an ink container which being mounted.
Figure 19:
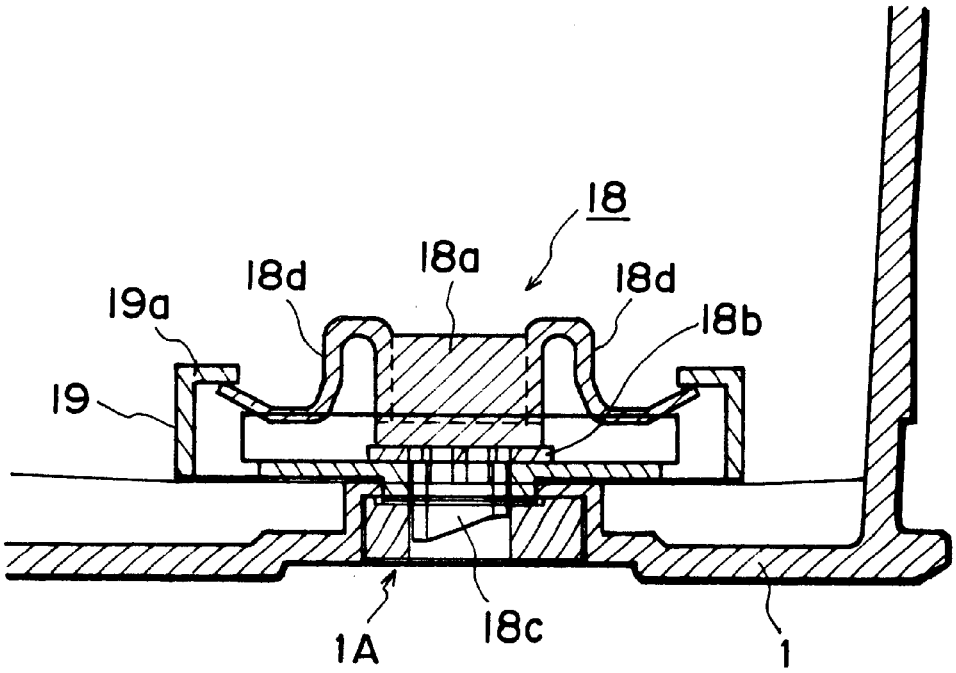
FIG. 19 is a drawing for depicting another valving mechanism different in structure from the preceding valving mechanisms.

Thus, the valve stem 18*c* may be shortened, as shown in FIG. 19, on the side by which it makes contact with the tip of the ink delivery tube 3 when the ink container is mounted as shown in FIG. 18. With such an arrangement, the tip of the ink delivery tube 3 comes into contact with the valve stem 18*c* of the valving mechanism 18 with such a timing that the ink delivery hole 1A is unblocked after the interface between the ink delivery tube 3 and ink container is airtightly sealed. Therefore, it does not occur that ink leaks due to premature unblocking of the ink delivery hole 1A; in other words, the ink delivery tube 3 and ink container are flawlessly connected.

Figure 20:
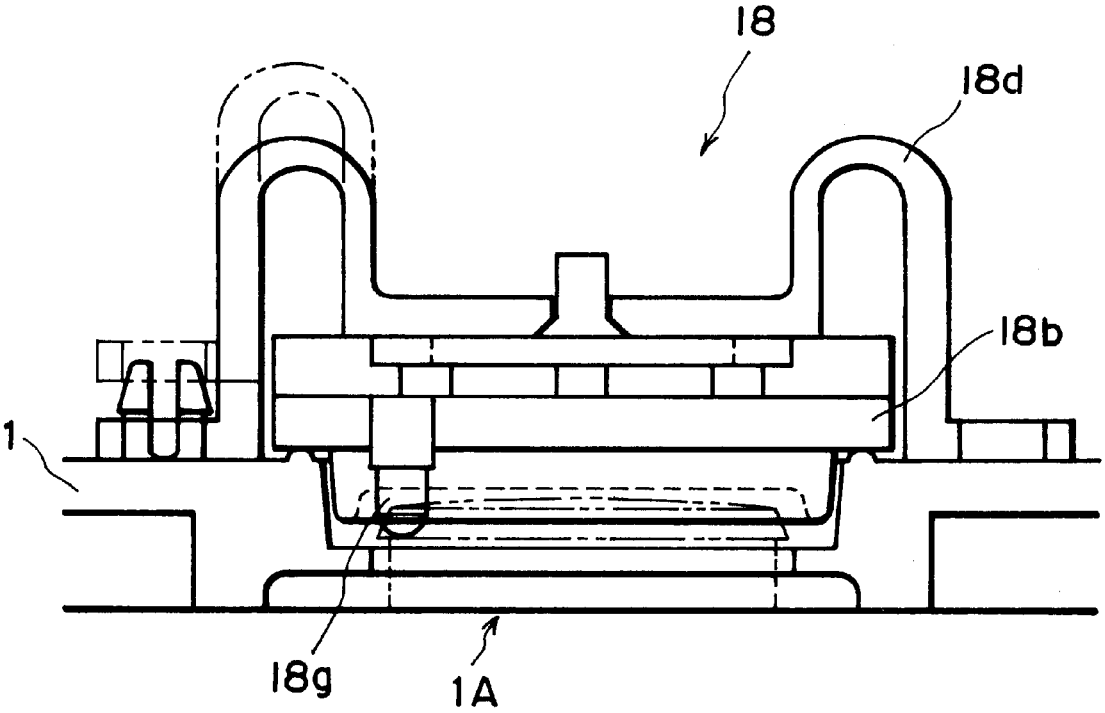
FIG. 20 is a drawing for depicting another valving mechanism different in structure from the preceding valving mechanisms.

Further, it is possible to deal with the above described problem by providing the valving mechanism 18 with a projection 18*g* as shown in FIG. 20, instead of changing the length of the valve stem portion of the valving mechanism 18. In this case, the ink delivery tube 3 makes direct contact with the projection 18*g* without coming into direct contact with the valve stem 18*c* of the valving mechanism 18, and therefore, attention should be paid to the manner in which the interface between the ink delivery tube 3 and ink container is sealed.

Figure 21:
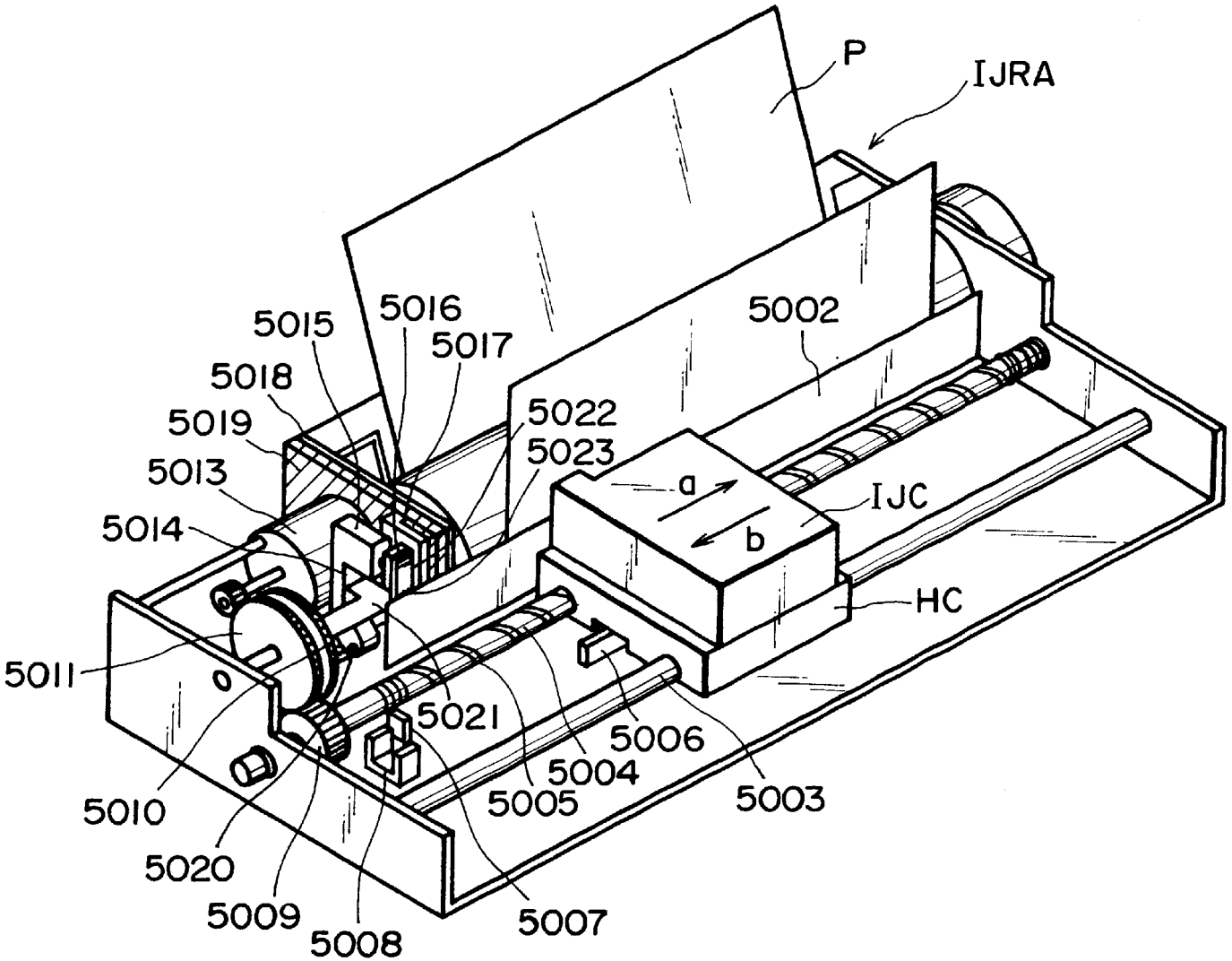
FIG. 21 is a perspective view of an example of an ink jet recording apparatus to which the present invention is applicable.

FIG. 21 is a drawing for describing an ink jet recording apparatus IJRA, which is compatible with the ink container in each of the above described embodiments, and also is compatible with an ink jet cartridge comprising any of the above described ink containers and an ink jet recording head.

A lead screw 5005 is rotated by the forward or reverse rotation of a driving motor 5013 through driving force transmission gears 5011 and 5009. A carriage HC has an unshown pin which engages in the spiral groove of the lead screw 5005, and is reciprocally moved in either of the directions indicated by an arrow mark a or b according to the rotational direction of the lead screw 5005. On the carriage HC, an ink jet cartridge IJC is mounted. Designated by a referential code 5002 is a pressing plate, which presses recording medium such as paper or OHP film upon a platen 5005, across the entire moving range of the carriage HC. Referential codes 5007 and 5008 designate photo couplers as home position detecting means, which detect the lever 5006 of the carriage HC to switch the rotational direction of the motor 5013, or to carry out the like operations. Designated by a referential code 5016 is a supporting member which supports a capping member 5022 which caps the recording head. Designated by a referential code 5015 is a suctioning means for vacuuming the interior of the capping member 5022. The suctioning means keeps the ink ejection performance of the recording head at a preferable level by suctioning the ink which does not contribute to image recording, from the recording head through the hole 5023 of the capping member 5022. A referential code 5017 designates a cleaning blade, and a referential code 5019 designates a member which makes it possible for the cleaning blade to be moved forward or backward. These members are supported on a supporting plate 5018 on the main assembly side. A referential code 5012 designates a lever for triggering the suction based performance recovery operation. It moves to control the transmission of the driving force from the driving motor, as a cam 5020 in engagement with the carriage HC moves.

As described above, according to the present invention, the main structure of an ink container is provided with a combination of an ink retaining member which is placed within the main structure, a pressure regulating means which regulates the internal pressure of the main structure, and a valving mechanism which unblocks or blocks the ink delivery hole of the main structure. Therefore, ink is always properly retained in the main structure of the ink container to be stably supplied, and the fluctuation of the internal pressure of the main structure of the ink container for which the changes in the environment of the ink container, or the like, is responsible, can be suppressed to prevent ink leakage or the like problems.

Further, the provision of a valving mechanism reduces ink flow resistance, making it possible to flawlessly supply ink to a recording head compatible with high speed printing.

While the invention has been described with reference to the structures disclosed herein, it is not confined to the details set forth, and this application is intended to cover such modifications or changes as may come within the purposes of the improvements or the scope of the following claims.

What is claimed is:

1. An ink container for supplying ink out of a main body thereof through an ink supply port, said container comprising:

an ink retaining material for retaining the ink in the main body of the container;

pressure adjusting means for adjusting a pressure in the main body; and a valve member disposed in the ink supply port, said valve member including a plug member for plugging said ink supply port and an elastic member for urging said plug member to plug said ink supply port;

wherein said plug member includes an extension extended outwardly of said ink supply port, said extension being sized not to extend beyond said ink container; and wherein said ink container is rotated when it is connected with a recording head, and wherein said extension is relatively short at a portion relatively closer to a center of rotation of said ink container and is relatively long at a portion relatively remote from the center of rotation thereof.

2. An ink container according to claim 1, wherein said ink retaining material is an ink absorbing material.

3. An ink container according to claim 1, wherein said ink retaining material is an ink bladder for accommodating the ink.

4. An ink container according to claim 1, wherein said ink retaining member is provided in said main body by blow molding.

5. An ink container according to claim 1, wherein said pressure adjusting means includes at least one of a valve mechanism for releasing an internal pressure of said main body when the internal pressure is higher than a predetermined level and a valve mechanism for introducing ambient pressure into said main body when the internal pressure is lower than a predetermined level.

6. An ink container according to claim 1, wherein when said ink container is mounted to a recording head, an ink supply tube of the recording head is abutted to the extension to urge said plug member against the elastic member to open the ink supply port.

7. An ink container according to claim 1, wherein said main body includes a plurality of ink chambers for containing the ink, which are in fluid communication with each other, and wherein said ink retaining material is provided in at least one of said ink chambers, and said pressure adjusting means is provided in at least one of said ink chambers.

8. An ink container according to claim 7, wherein said ink chambers are separable.

9. An ink container for supplying ink out of a main body thereof through an ink supply port, said container comprising:

an ink retaining material for retaining the ink in the main body of the container;

pressure adjusting means for adjusting a pressure in the main body; and a valve member disposed in the ink supply port, said valve member including a plug member for plugging said ink supply port and an elastic member for urging said plug member to plug said ink supply port;

wherein said plug member includes an extension extended outwardly of said ink supply port, said extension being sized not to extend beyond said ink container; and wherein said ink container is rotated when it is connected with a recording head, and wherein said extension is provided with an outward projection at a portion relatively remote from the center of rotation of said ink container, and wherein said projection has such a length that it is not outside said container.

10. An ink container according to claim 9, wherein said ink retaining material is an ink absorbing material.

11. An ink container according to claim 9, wherein said ink retaining material is an ink bladder for accommodating the ink.

12. An ink container according to claim 9, wherein said ink retaining member is provided in said main body by blow molding.

13. An ink container according to claim 9, wherein said pressure adjusting means includes at least one of a valve mechanism for releasing an internal pressure of said main body when the internal pressure is higher than a predetermined level and a valve mechanism for introducing ambient pressure into said main body when the internal pressure is lower than a predetermined level.

14. An ink container according to claim 9, wherein when said ink container is mounted to a recording head, an ink supply tube of the recording head is abutted to the extension to urge said plug member against the elastic member to open the ink supply port.

15. An ink container according to claim 9, wherein said main body includes a plurality of ink chambers for containing the ink, which are in fluid communication with each other, and wherein said ink retaining material is provided in at least one of said ink chambers, and said pressure adjusting means is provided in at least one of said ink chambers.

16. An ink container according to claim 15, wherein said ink chambers are separable.

17. An ink cartridge comprising an ink container as defined in any one of claims 1–8 or 9–16, and an ink jet recording head constructed to eject the ink supplied through said ink supply port of said ink container.

18. An ink cartridge according to claim 17, wherein said ink container is separable from said ink jet recording head.

19. An ink cartridge according to claim 17, wherein said ink jet recording head is provided with electrothermal transducers for generating thermal energy to eject ink.

20. An ink supply system comprising:

an ink container as defined in claim 1 or 9;

a supply tube to be connected with the ink supply port of said ink container;

an ink jet recording head connectable with said ink supply tube to eject the ink supplied from said container.

* * * * *